US007135431B2

(12) United States Patent
Iwasaki et al.

(10) Patent No.: US 7,135,431 B2
(45) **Date of Patent: *Nov. 14, 2006**

(54) THERMOSENSITIVE RECORDING MATERIAL

(75) Inventors: Masayuki Iwasaki, Shizuoka-ken (JP); Tsutomu Watanabe, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/479,256

(22) PCT Filed: May 31, 2002

(86) PCT No.: PCT/JP02/05346

§ 371 (c)(1),
(2), (4) Date: Dec. 1, 2003

(87) PCT Pub. No.: WO02/098673

PCT Pub. Date: Dec. 12, 2002

(65) Prior Publication Data

US 2004/0176247 A1 Sep. 9, 2004

(30) Foreign Application Priority Data

| | | |
|---|---|---|
| Jun. 1, 2001 | (JP) | 2001-166732 |
| Jun. 28, 2001 | (JP) | 2001-197202 |
| Aug. 24, 2001 | (JP) | 2001-254212 |
| Aug. 24, 2001 | (JP) | 2001-254213 |
| Aug. 24, 2001 | (JP) | 2001-254214 |

(51) Int. Cl.
*B41M 5/30* (2006.01)

(52) U.S. Cl. ..... 503/209; 503/216; 503/221

(58) Field of Classification Search ..... 503/209, 503/216, 221

See application file for complete search history.

(56) References Cited

U.S. PATENT DOCUMENTS

| | | | | |
|---|---|---|---|---|
| 4,396,684 | A | 8/1983 | Morishita et al. | |
| 4,414,259 | A | 11/1983 | Tsuchiya et al. | |
| 4,585,483 | A | 4/1986 | Ikeda et al. | |
| 5,068,133 | A | 11/1991 | Matsumoto et al. | |
| 5,071,821 | A | 12/1991 | Smith et al. | |
| 5,112,798 | A | 5/1992 | Miyauchi | |
| 5,721,190 | A | 2/1998 | Miyamoto et al. | |
| 6,410,479 | B1 | 6/2002 | Fukuchi et al. | |
| 6,497,926 | B1 | 12/2002 | Yokota et al. | |
| 6,596,358 | B1 | 7/2003 | Sakamoto et al. | |
| 6,642,175 | B1 | 11/2003 | Mitsuo et al. | |
| 6,699,816 | B1 * | 3/2004 | Iwasaki et al. | 503/209 |
| 6,818,592 | B1 * | 11/2004 | Watanabe et al. | 503/208 |
| 6,852,671 | B1 * | 2/2005 | Iwasaki et al. | 503/216 |
| 6,972,272 | B1 | 12/2005 | Iwasaki et al. | |
| 2004/0235660 | A1 | 11/2004 | Iwasaki et al. | |
| 2005/0054527 | A1 | 3/2005 | Iwasaki et al. | |
| 2005/0088508 | A1 | 4/2005 | Iwasaki et al. | |
| 2005/0170959 | A1 | 8/2005 | Iwasaki et al. | |

FOREIGN PATENT DOCUMENTS

| | | | |
|---|---|---|---|
| EP | 0 405 363 | A2 | 1/1991 |
| EP | 0 462 770 | A1 | 12/1991 |
| EP | 0 542 556 | A1 | 5/1993 |
| EP | 0 992 363 | A1 | 4/2000 |
| EP | 1 060 904 | A2 | 12/2000 |
| JP | 49-24133 | B | 6/1974 |
| JP | 54-74761 | A | 6/1979 |
| JP | 56-17286 | A | 2/1981 |
| JP | 57-41995 | A | 3/1982 |
| JP | 57-212094 | A | 12/1982 |
| JP | 59-214686 | A | 12/1984 |
| JP | 61-57387 | A | 3/1986 |
| JP | 1-306282 | A | 12/1989 |
| JP | 2-20385 | A | 1/1990 |
| JP | 3-500516 | A | 2/1990 |
| JP | 2-169291 | A | 6/1990 |
| JP | 3-128278 | A | 5/1991 |
| JP | 3-193458 | A | 8/1991 |
| JP | 3-290285 | A | 12/1991 |
| JP | 4-1085 | A | 1/1992 |
| JP | 4-105987 | A | 4/1992 |
| JP | 4-110188 | A | 4/1992 |
| JP | 4-221681 | A | 8/1992 |
| JP | 4-325285 | A | 11/1992 |

(Continued)

*Primary Examiner*—Bruce H. Hess
(74) *Attorney, Agent, or Firm*—Sughrue Mion, PLLC

(57) ABSTRACT

A thermosensitive recording material of the present invention has a thermosensitive color developing layer on a support, and the thermosensitive color developing layer contains at least an electron-donating colorless dye and 4-hydroxybenzenesulfone anilide as an electron-accepting compound. The thermosensitive recording material of the invention meets any one of the following conditions: the thermosensitive recording surface of the thermosensitive recording material has an Oken smoothness of at least 300 seconds; 1,1,3-tris(2-methyl-4-hydroxy-5-tert-butylphenyl)-butane and/or 1,1,3-tris(2-methyl-4-hydroxy-5-cyclohexyl-phenyl)butane is contained as an image stabilizer; at least one selected from 2-anilino-3-methyl-6-di-n-butylaminofluorane and 2-anilino-3-methyl-6-di-n-amylaminofluorane is contained as the electron-donating colorless dye; a sensitizer and 2-anilino-3-methyl-6-(N-ethyl-N-p-benzyl)aminofluorane as the electron-donating colorless dye are contained; and the image stabilizer and at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye are contained.

11 Claims, No Drawings

FOREIGN PATENT DOCUMENTS

| | | | |
|---|---|---|---|
| JP | 4-332682 | A | 11/1992 |
| JP | 05-32052 | A | 2/1993 |
| JP | 5-104062 | A | 4/1993 |
| JP | 6-72051 | A | 3/1994 |
| JP | 6-179290 | A | 6/1994 |
| JP | 6-183158 | A | 7/1994 |
| JP | 6-210952 | A | 8/1994 |
| JP | 6-344671 | A | 12/1994 |
| JP | 7-89237 | A | 4/1995 |
| JP | 7-290835 | A | 11/1995 |
| JP | 7-314896 | A | 12/1995 |
| JP | 7-314914 | A | 12/1995 |
| JP | 8-39937 | A | 2/1996 |
| JP | 8-118808 | A | 5/1996 |
| JP | 9-131969 | A | 5/1997 |
| JP | 9-142018 | A | 6/1997 |
| JP | 9-150584 | A | 6/1997 |
| JP | 10-35103 | A | 2/1998 |
| JP | 11-48610 | A | 2/1999 |
| JP | 11-70736 | A | 3/1999 |
| JP | 11-208122 | A | 8/1999 |
| JP | 11-254837 | A | 9/1999 |
| JP | 11-291633 | A | 10/1999 |
| JP | 11-342676 | A | 12/1999 |
| JP | 2000-168242 | A | 6/2000 |
| JP | 2000-247037 | A | 9/2000 |
| JP | 2000-247038 | A | 9/2000 |
| JP | 2000-263944 | A | 9/2000 |
| JP | 2000-326632 | A | 11/2000 |
| JP | 2000-345067 | A | 12/2000 |
| JP | 2000-347341 | A | 12/2000 |
| JP | 2001-113837 | A | 4/2001 |
| JP | 2001-162935 | A | 6/2001 |
| JP | 2001-246863 | A | 9/2001 |
| JP | 2001-293956 | A | 10/2001 |
| JP | 2002-86910 | A | 3/2002 |
| JP | 2002-127601 | A | 5/2002 |
| JP | 2002-127604 | A | 5/2002 |
| JP | 2002-264534 | A | 9/2002 |
| JP | 2002-301873 | A | 10/2002 |
| WO | WO 00/53427 | A1 | 9/2000 |
| WO | WO 02/098673 | A1 | 12/2002 |
| WO | WO 03/002354 | A1 | 1/2003 |

* cited by examiner

THERMOSENSITIVE RECORDING MATERIAL

TECHNICAL FIELD

The present invention relates to a thermosensitive recording material, and particularly to a thermosensitive recording material having superior image preservability and chemical resistance and having adaptability to inkjet recording.

BACKGROUND ART

In general, since thermosensitive recording materials are relatively inexpensive, and recording instruments thereof are compact and are free from maintenance, the thermosensitive recording materials are broadly used. In recent years, a sales competition of thermosensitive paper has intensified, and thermosensitive recording materials are required to have higher functions that can be differentiated from conventional functions. Accordingly, the thermosensitive recording materials are extensively studied with respect to color density, image preservability, and the like.

Hitherto, 2,2-bis(4-hydroxyphenyl)propane (so-called "bisphenol A") has been widely used as an electron-accepting compound for an electron-donating dye to be used in such thermosensitive recording materials. However, a material that is satisfactory from the viewpoints of sensitivity, background fogging prevention, image preservability, chemical resistance, anti-sticking properties, and the like has not yet been obtained.

On the other hand, Japanese Patent Application Publication (JP-B) No. 4-20792 discloses recording materials using an N-substituted sulfamoylphenol or N-substituted sulfamoylnaphthol as the electron-accepting compound and describes that the (pressure-sensitive or thermosensitive) recording materials are improved with respect to image density, image stability, and cost. However, there is room for further improvements in image density and image preservability.

Further, in cases where full-color information is recorded on thermosensitive recording materials, recording using inkjet inks is often conducted. When inkjet printing is performed on ordinary thermosensitive recording materials, colors of the inks may not be completely reproduced, and vivid colors do not appear, whereby the resulting colors become dull. It has been noted that when inkjet recording is performed on the thermosensitive recording material described in JP-B No. 4-20792, a problem arises in that the colors are dull and blackish.

DISCLOSURE OF INVENTION

In view of the foregoing problems, the present invention has been made. A first object of the invention is to provide a thermosensitive recording material that is high in color density, less in background fogging and superior in preservability of image portions and chemical resistance of image portions and background portions, and is provided with adaptability to inkjet recording.

Further, a second object of the invention is to provide a thermosensitive recording material that is high in sensitivity and superior in image preservability, chemical resistance, resistance to inkjet inks and sticking properties.

Moreover, a third object of the invention is to provide a thermosensitive recording material that is high in color density, less in background fogging and superior in preservability of image portions and chemical resistance of image portions and background portions, and is provided with adaptability to inkjet recording.

Still further, a fourth object of the invention is to provide a thermosensitive recording material that is high in color density, less in background fogging and superior in preservability of image portions, background light fastness and chemical resistance of image portions and background portions, and is provided with adaptability to inkjet recording.

Even further, a fifth object of the invention is to provide a thermosensitive recording material that is high in color density, less in background fogging and superior in preservability of image portions, chemical resistance and anti-sticking properties, and is provided with adaptability to inkjet recording.

A first aspect of the invention is to provide a thermosensitive recording material comprising a support having thereon a thermosensitive color developing layer containing at least an electron-donating colorless dye and an electron-accepting compound, wherein the thermosensitive color developing layer contains 4-hydroxybenzenesulfone anilide as the electron-accepting compound, and a thermosensitive recording surface of the thermosensitive recording material has an Oken smoothness of at least 300 seconds.

Due to the matter that the thermosensitive color developing layer contains 4-hydroxybenzenesulfone anilide as the electron-accepting compound and that the thermosensitive recording surface of the thermosensitive recording material has an Oken smoothness of at least 300 seconds, the first aspect of the invention can provide a thermosensitive recording material that is high in color density, less in background fogging and superior in preservability of image portions, chemical resistance and resistance to printing trouble due to friction between a head and paper, and is provided with adaptability to inkjet recording, as compared with the conventional thermosensitive recording materials.

A second aspect of the invention is to provide a thermosensitive recording material comprising a support having thereon a thermosensitive color developing layer containing an electron-donating colorless dye and an electron-accepting compound, wherein the thermosensitive color developing layer contains 4-hydroxybenzenesulfone anilide as the electron-accepting compound and 1,1,3-tris(2-methyl-4-hydroxy-5-tert-butylphenyl)butane and/or 1,1,3-tris(2-methyl-4-hydroxy-5-cyclohexylphenyl)butane as an image stabilizer.

The second aspect of the invention can provide a thermosensitive recording material that is especially high in sensitivity and superior in preservability of image portions, chemical resistance and resistance to inkjet inks and that is not practically problematic with respect to background fogging, as compared with the conventional thermosensitive recording materials.

A third aspect of the invention is to provide a thermosensitive recording material comprising a support having thereon a thermosensitive color developing layer containing an electron-donating colorless dye and an electron-accepting compound, wherein the thermosensitive color developing layer contains at least one selected from 2-anilino-3-methyl-6-di-n-butylaminofluorane and 2-anilino-3-methyl-6-di-n-amylaminofluorane as the electron-donating colorless dye and 4-hydroxybenzenesulfone anilide as the electron-accepting compound.

The third aspect of the invention can provide a thermosensitive recording material that is high in color density, less in background fogging and superior in preservability of image portions and chemical resistance of image portions and background portions, and is provided with adaptability to inkjet recording.

A fourth aspect of the invention is to provide a thermosensitive recording material comprising a support having thereon a thermosensitive color developing layer containing an electron-donating colorless dye, an electron-accepting compound and a sensitizer, wherein the thermosensitive color developing layer contains 2-anilino-3-methyl-6-(N-ethyl-N-p-benzyl)aminofluorane as the electron-donating colorless dye and 4-hydroxybenzenesulfone anilide as the electron-accepting compound.

The fourth aspect of the invention can provide a thermosensitive recording material that is high in color density, less in background fogging and superior in preservability of image portions, background light fastness and chemical resistance of image portions and background portions, and is provided with adaptability to inkjet recording.

A fifth aspect of the invention is to provide a thermosensitive recording material comprising a support having thereon a thermosensitive color developing layer containing an electron-donating colorless dye, an electron-accepting compound and an image stabilizer, wherein the thermosensitive color developing layer contains at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye and 4-hydroxybenzenesulfone anilide as the electron-accepting compound.

The fifth aspect of the invention can provide thermosensitive recording material that is high in color density, less in background fogging and superior in preservability of image portions, chemical resistance and anti-sticking properties, and is provided with adaptability to inkjet recording.

BEST MODE FOR CARRYING OUT THE INVENTION

<<Thermosensitive Recording Material>>

The thermosensitive recording material of the present invention is a thermosensitive recording material comprising a support having thereon a thermosensitive color developing layer containing an electron-donating colorless dye and an electron-accepting compound, wherein the thermosensitive color developing layer contains 4-hydroxybenzenesulfone anilide as the electron-accepting compound.

In the first aspect, the thermosensitive recording surface of the thermosensitive recording material has an Oken smoothness of at least 300 seconds. In the second aspect, it is preferable that the thermosensitive recording surface of the thermosensitive recording material has an Oken smoothness of at least 300 seconds. The Oken smoothness is preferably at least 500 seconds, and more preferably at least 700 seconds. The Oken smoothness is measured by the method as defined in J. TAPPI No. 5.

In order to obtain thermosensitive recording materials having a large smoothness, not only supports having a high smoothness are used as the support as described later, but also the surface of the thermosensitive color developing layer is subjected to calendering processing or the like.

In the thermosensitive recording material according to the first aspect of the invention, 4-hydroxybenzenesulfone anilide is used as the electron-accepting compound, and the thermosensitive recording surface of the thermosensitive recording material has an Oken smoothness of at least 300 seconds. Thus, the resulting thermosensitive recording material is superior in sensitivity, fogging, image preservability, chemical resistance and resistance to printing trouble due to friction between a head and paper, and is provided with adaptability to inkjet recording. When the condition of the Oken smoothness is not met, the resulting thermosensitive recording material is not satisfactory in sensitivity.

Further, in the thermosensitive recording materials according to the first and second aspects of the invention, in order to prevent corrosion of thermal heads, the total ion concentration of $Na^+$ ions and $K^+$ ions contained therein is preferably 1,500 ppm or less, more preferably 1,000 ppm, and especially preferably 800 ppm.

The ion concentration of $Na^+$ ions and $K^+$ ions is measured by extracting components from the thermosensitive recording material with hot water and subjecting the extract to ionic quantitative analysis by the atomic absorption method to measure the ion masses of $Na^+$ ions and $K^+$ ions. The concentration is expressed in terms of ppm based on the whole mass of the thermosensitive recording material.

Moreover, in the thermosensitive recording material according to the first aspect of the invention, from the viewpoint of prevention of blotting of prints by an inkjet printer, a contact angle of the thermosensitive recording surface to water is preferably at least 20°, and more preferably at least 50°.

The contact angle is measured by an ordinary manner (for example, a dynamic contact angle absorption tester such as DAT1100 (trade name, manufactured by Fibro System ab) when 0.1 seconds has lapsed after dropping distilled water onto the thermosensitive recording surface of the thermosensitive recording material.

In addition, in the thermosensitive recording materials according to the first and second aspects of the invention, an image retention rate is preferably at least 65%. The image retention rate is expressed in terms of a rate of the image density of an image after standing in an atmosphere at 60° C. and at a relative humidity of 20% for 24 hours to the image density immediately after printing, as measured by a Macbeth reflection densitometer (for example, RD-918).

$$\text{Image retention rate}=[(\text{Image density after standing under the foregoing condition})/(\text{Image density immediately after printing})]\times 100$$

The thermosensitive recording material of the invention will be hereunder explained.

<Support>

Conventionally known supports can be used in the invention. Specific examples thereof include paper supports such as wood-free paper, coated paper in which paper is coated with a resin or a pigment, resin-laminated paper, wood-free paper provided with an undercoat layer, synthetic paper, and plastic films. From the viewpoint of thermal head matching characteristic, wood-free paper provided with an undercoat layer is preferable, and wood-free paper provided with an undercoat layer containing an oil-absorbing pigment which undercoat layer is provided using a blade coater is especially preferable.

Smooth supports having a smoothness, as defined in JIS-8119, of from 300 seconds to 500 seconds are preferable from the viewpoint of dot reproducibility. In order that the thermosensitive recording surface has a smooth surface having an Oken smoothness of at least 300 seconds, it is especially preferable that the smoothness as defined in JIS-8119 is at least 100. Further, in order that the thermosensitive recording surface has a smooth surface having an Oken smoothness of at least 500 seconds, it is preferable that the smoothness as defined in JIS-8119 is at least 200; and in order that the thermosensitive recording surface has a smooth surface having an Oken smoothness of at least 700 seconds, it is preferable that the smoothness as defined in JIS-8119 is at least 300 seconds.

In addition, the support that is used in the invention may have an undercoat layer. In the case where the undercoat layer is provided on the support, it is preferable that the undercoat layer is provided on a support having a Stockigt size of at least 5 seconds and is made of a pigment and a binder as major components.

As the pigment, all of general inorganic or organic pigments can be used, but oil-absorbing pigments having an oil absorbency, as defined in JIS-K5101, of at least 40 mL/100 g (cc/100 g) are especially preferable. Examples of the oil-absorbing pigments include calcined kaolin, aluminum oxide, magnesium carbonate, calcium carbonate, barium sulfate, amorphous silica, calcined diatomaceous earth, aluminum silicate, kaolin, magnesium aluminosilicate, aluminum hydroxide, and urea-formalin resin powders. Among these, calcined kaolin having an oil absorption, as defined in JIS-K5101, of from 70 to 80 mL/100 g is especially preferable.

Examples of the binder that is used in the undercoat layer include water-soluble polymers and aqueous binders. These materials may be used alone or in admixture of two or more thereof.

Examples of the water-soluble polymers include starch, polyvinyl alcohol, polyacrylamide, carboxymethyl cellulose, methyl cellulose, and casein.

As the aqueous binders, synthetic rubber latices and synthetic resin emulsions are general, and examples thereof include a styrene-butadiene rubber latex, an acrylonitrile-butadiene rubber latex, a methyl acrylate-butadiene rubber latex, and a vinyl acetate emulsion.

The amount of the binder to be used depends upon the film strength of the coating layer or the thermosensitivity of the thermosensitive color developing layer, but is from 3 to 100% by mass, preferably from 5 to 50% by mass, and especially preferably from 8 to 15% by mass on a basis of the pigment to be added to the undercoat layer. Further, wax, a discoloration-preventing agent, a surfactant, and the like may be added to the undercoat layer.

Known application methods can be used in application of the undercoat layer. Concretely, methods using an air knife coater, a roll coater, a blade coater, a gravure coater, a curtain coater, or the like can be used, and the method using a blade coater is preferable. Further, the undercoat layer may be subjected to smoothening processing such as calendering and then put into use, if desired.

The method using a blade coater is not limited to coating methods using a bevel type or vent type blade, and includes rod blade coating and bill blade coating. Further, the application is not limited to those using an off-machine coater, but may be performed with an on-machine coater installed in a paper machine. Incidentally, in order to obtain superior smoothness and surface properties by imparting fluidity during blade coating, carboxymethyl cellulose having an etherification degree of from 0.6 to 0.8 and a weight average molecular weight of from 20,000 to 200,000 may be added to the coating solution for undercoat layer in an amount of from 1 to 5% by mass, and preferably from 1 to 3% by mass on a basis of the pigment.

The application amount of the undercoat layer is not particularly limited, but is usually at least 2 g/m$^2$, preferably at least 4 g/m$^2$, and especially preferably from 7 g/m$^2$ to 12 g/m$^2$ according to the characteristics of the thermosensitive recording material.

<Thermosensitive Color Developing Layer>

The thermosensitive color developing layer to be formed on the support contains at least an electron-donating colorless dye and an electron-accepting compound and may further contains a sensitizer, an image stabilizer and a UV absorbent.

(Electron-Donating Colorless Dye)

In the first and second aspects, the electron-donating colorless dye is preferably at least one selected from 2-anilino-3-methyl-6-diethylaminofluorane, 2-anilino-3-meth-yl-6-(N-ethyl-N-isoamylamino)fluorane, and 2-anilino-3-methyl-6-(N-ethyl-N-propylamino)fluorane. These compounds may be used alone or in admixture of two or more thereof.

By using at least one selected from 2-anilino-3-methyl-6-diethylaminofluorane, 2-anilino-3-methyl-6-(N-ethyl-N-isoamylamino)fluorane, and 2-anilino-3-methyl-6-(N-ethyl-N-propylamino)fluorane as the electron-donating colorless dye, it is possible to further enhance the color density and preservability of image portions.

Further, in the first and second aspects, besides the foregoing compounds, for example, 3-di(n-butylamino)-6-methyl-7-anilinofluorane, 2-anilino-3-methyl-6-N-ethyl-N-sec-butylaminofluorane, 3-di(n-pentylamino)-6-methyl-7-anilinofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino)fluorane, 3-diethylamino-6-methyl-7-anilinofluorane, and 3-(N-cyclohexyl-N-methylamino)-6-meth-yl-7-anilinofluorane may be used as the electron-donating colorless dye.

The thermosensitive recording material according to the third aspect of the invention contains at least one selected from 2-anilino-3-mthyl-6-di-n-butylaminofluorane and 2-anilino-3-methyl-6-di-n-amylaminofluorane as the electron-donating colorless dye.

Further, so far as the effects of the invention are not hindered, an electron-donating colorless dye other than the foregoing 2-anilino-3-methyl-6-di-n-butylaminofluorane and 2-anilino-3-methyl-6-di-n-amylaminofluorane may be used together with the foregoing compound as the electron-donating colorless dye. In the case where other electron-donating colorless dye is used together with the foregoing compound, the content of the foregoing 2-anilino-3-methyl-6-di-n-butylaminofluorane or 2-anilino-3-methyl-6-di-n-amylaminofluorane (the total content in the case where the both are used together) is preferably at least 50% by mass, more preferably at least 70% by mass, and most preferably at least 90% by mass of the whole mass of the electron-donating colorless dyes.

In the third aspect, examples of such other electron-donating colorless dyes include 2-anilino-3-methyl-6-(N-ethyl-N-p-benzyl)aminofluorane, 2-anilino-3-methyl-6-diethylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-N-ethyl-N-sec-butylaminofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino)fluorane, 3-diethylamino-6-methyl-7-anilinofluorane, and 3-(N-cyclohexyl-N-methylamino)-6-methyl-7-anilinofluorane.

The thermosensitive recording material according to the fourth aspect of the invention contains 2-anilino-3-methyl-6-(N-ethyl-N-p-benzyl)aminofluorane as the electron-donating colorless dye.

Further, so far as the effects of the invention are not hindered, an electron-donating colorless dye other than the foregoing 2-anilino-3-methyl-6-(N-ethyl-N-p-benzyl) amino-fluorane may be used together with the foregoing compound as the electron-donating colorless dye. In the case where other electron-donating colorless dye is used together, the content of the foregoing 2-anilino-3-methyl-6-(N-ethyl-N-p-benzyl)aminofluorane is preferably at least 50% by mass, more preferably at least 70% by mass, and most preferably at least 90% by mass of the whole mass of the electron-donating colorless dyes.

In the fourth aspect, examples of such other electron-donating colorless dyes include 2-anilino-3-methyl-6-di-n-butylaminofluorane, 2-anilino-3-methyl-6-di-n-amylaminofluorane, 2-anilino-3-methyl-6-diethylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-N-ethyl-N-sec-butylaminofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino)fluorane, and 3-(N-cyclohexyl-N-methylamino)-6-methyl-7-anilinofluorane.

The thermosensitive recording material according to the fifth aspect of the invention contains at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye.

Further, so far as the effects of the invention are not hindered, an electron-donating colorless dye other than the foregoing 2-anilino-3-methyl-6-di-n-butylaminofluorane, 2-anilino-3-methyl-6-di-n-amylaminofluorane and 2-anilino-3-methyl-6-(N-ethyl-N-p-benzyl)aminofluorane may be used together with the foregoing compound as the electron-donating colorless dye. In the case where other electron-donating colorless dye is used together, the content of the foregoing 2-anilino-3-methyl-6-di-n-butylaminofluorane, 2-anilino-3-methyl-6-di-n-amylaminofluorane or 2-anilino-3-methyl-6-(N-ethyl-N-p-benzyl)aminofluorane (the total content in the case where these compounds are used together) is preferably at least 50% by mass, more preferably at least 70% by mass, and most preferably at least 90% by mass of the whole mass of the electron-donating colorless dyes.

In the fifth aspect, examples of such other electron-donating colorless dyes include 2-anilino-3-methyl-6-diethylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-N-ethyl-N-sec-butylaminofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino)fluorane, and 3-(N-cyclohexyl-N-methylamino)-6-methyl-7-anilinofluorane.

The application amount of the electron-donating colorless dye is preferably from 0.1 to 1.0 g/m$^2$, and, from the viewpoints of color density and background fogging density, more preferably from 0.2 to 0.5 g/m$^2$.

(Electron-accepting Compound)

The thermosensitive recording material of the invention is characterized by containing 4-hydroxybenzenesulfone anilide as the electron-accepting compound. By containing the foregoing 4-hydroxybenzenesulfone anilide as the electron-accepting compound, the thermosensitive recording material of the invention can increase color density, make the background fogging less and enhance chemical resistance. Alternatively, the thermosensitive recording material of the invention can increase sensitivity and enhance image preservability, chemical resistance and sticking properties.

In the first and second aspects, the addition amount of the electron-accepting compound is preferably from 50 to 400% by mass, and especially preferably from 10 to 300% by mass on a basis of the electron-donating colorless dye.

In the third to fifth aspects, the content of the electron-accepting compound is preferably from 100 to 300 parts by mass, more preferably from 150 to 300 parts by mass, and most preferably from 200 to 250 parts by mass based on 100 parts by mass of the electron-donating colorless dye. When the content of the electron-accepting compound falls within the above-specified range, the effects of the invention can be exhibited more effectively.

In the invention, so far as the effects of the invention are not hindered, a known electron-accepting compound other than 4-hydroxybenzenesulfone anilide may be used together with 4-hydroxybenzenesulfone anilide as the electron-accepting compound.

The known electron-accepting compound can be properly selected and used, but phenolic compounds or salicylic acid derivatives and polyvalent metal salts thereof are especially preferable from the viewpoint of inhibition of the background fogging.

Examples of the phenolic compounds include 2,2'-bis(4-hydroxyphenol)propane (bisphenol A), 4-t-butylphenol, 4-phenylphenol, 4-hydroxydiphenoxide, 1,1'-bis(4-hydroxyphenyl)cyclohexane, 1,1'-bis(3-chloro-4-hydroxy-phenyl) cyclohexane, 1,1'-bis(3-chloro-4-hydroxyphenyl)-2-ethylbutane, 4,4'-sec-isooctylidene diphenol, 4,4'-sec-butylene diphenol, 4-tert-octylphenol, 4-p-methylphenylphenol, 4,4'-methylcyclohexylidene phenol, 4,4'-isopentylidene phenol, 4-hydroxy-4-isopropyloxy-diphenylsulfone, 4,4'-dihydroxydiphenylsulfone, 2,4'-di-hydroxydiphenylsulfone, 2,4-bis(phenylsulfonyl)phenol, N-(4-hydroxyphenyl)-p-toluene sulfonamide, and benzyl p-hydroxybenzoate.

Examples of the salicylic acid derivatives include 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper, and lead salts thereof.

In the invention, in the case where the foregoing known electron-accepting compounds are used together with 4-hydroxybenzenesulfone anilide, the content of the foregoing 4-hydroxybenzenesulfone anilide is preferably at least 50% by mass, more preferably at least 70% by mass, and most preferably at least 90% by mass of the whole mass of the electron-accepting compounds.

In the invention, when a coating solution for the thermosensitive color developing layer is prepared, the size of the electron-accepting compound particles is preferably 1.0 μm or less, and more preferably from 0.4 to 0.7 μm in terms of volume mean particle size. When the volume mean particle size exceeds 1.0 μm, thermosensitivity may lower. The volume mean particle size can be easily measured by a laser diffraction type particle size distribution measurement device (for example, LA500 (trade name) manufactured by Horiba, Ltd.), and the like.

(Sensitizer)

The thermosensitive recording material according to the first aspect of the invention preferably contains at least one selected from 2-benzyloxynaphthalene, dimethylbenzyl oxalate, m-terphenyl, ethylene glycol tolyl ether, p-benzylbiphenyl, and 1,2-diphenoxymethylbenzene as a sensitizer in the thermosensitive color developing layer. By containing such a sensitizer, it is possible to enhance sensitivity more.

The thermosensitive recording material according to the second aspect of the invention contains 2-benzyloxynaphthalene and stearic acid amide as a sensitizer in the thermosensitive color developing layer.

When the thermosensitive recording material according to the second aspect of the invention contains 2-benzyl-oxynaphthalene and stearic acid amide as the sensitizer in the thermosensitive color developing layer, sensitivity can be enhanced more.

The mass ratio (x/y) of 2-benzyloxynaphthalene (x) to stearic acid amide (y) is preferably from 95/5 to 40/60. When the mass ratio is less than 95/5, sensitivity becomes low. Even when it exceeds 40/60, sensitivity becomes low, too. The mass ratio is more preferably from 90/10 to 50/50, and especially preferably from 85/15 to 70/30.

In the thermosensitive recording materials according to the third to fifth aspects, it is preferable to contain at least one selected from 2-benzyl naphthyl ether, 1,2-bis(3-methylphenoxy)ethane, and 1,2-diphenoxymethylbenzene as a sensitizer in the thermosensitive color developing layer. By containing such a sensitizer, it is possible to enhance sensitivity more.

In the first and second aspects, the content of the sensitizer is preferably from 75 to 200 parts by mass, and more preferably from 100 to 150 parts by mass based on 100 parts by mass of 4-hydroxybenzenesulfone anilide as the electron-accepting compound. When the content of the sensitizer falls within the range of from 75 to 200 parts by mass, not only the effect of enhancement of sensitivity is large, but also image preservability is good.

In the third to fifth aspects, the content of the sensitizer is preferably from 100 to 300 parts by mass, more preferably from 150 to 300 parts by mass, and most preferably from 200 to 250 parts by mass based on 100 parts by mass of the electron-donating colorless dye. When the content of the sensitizer falls within the above-specified range, not only the effect of enhancement of sensitivity is large, but also image preservability is enhanced.

So far as the effects of the invention are not hindered, a sensitizer other than the foregoing sensitizers may be used together with the foregoing sensitizer in the thermosensitive color developing layer according to the invention. In the first, third and fourth aspects, in the case where other sensitizer is contained, the content of the foregoing sensitizer is preferably at least 50% by mass, more preferably at least 70% by mass, and most preferably at least 90% by mass of the whole mass of the sensitizers.

Examples of such other sensitizer include dimethylbenzyl oxalate, ethylene glycol tolyl ether, stearic acid amide, aliphatic monoamides, stearylurea, p-benzylbiphenyl, di(2-methylphenoxy)ethane, di(2-methoxyphenoxy)ethane, β-naphthol-(p-methylbenzyl) ether, α-naphthyl benzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediolphenyl ether, diethylene glycol bis(4-methoxyphenyl) ether, m-terphenyl, methyl oxalate benzyl ether, 1,2-diphenoxymethylbenzene, 1,2-bis(3-methylphenoxy)ethane, and 1,4-bis(phenoxymethyl)benzene.

(Image Stabilizer)

In addition, the thermosensitive color developing layer may contain an image stabilizer.

In the first and third to fifth aspects, phenol compounds, especially hindered phenol compounds are effective as the image stabilizer. Examples thereof include 1,1,3-tris(2-methyl-4-hydroxy-5-tert-butylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

Among them, it is preferable to contain at least one selected from 1,1,3-tris(2-methyl-4-hydroxy-5-tert-butylphenyl)butane and 1,1,3-tris(2-methyl-4-hydroxy-5-cyclohexylphenyl)butane. By containing such an image stabilizer, not only background fogging can be improved but also the preservability of the image portions can be further enhanced due to mutual action with 4-hydroxybenzenesulfone anilide as the electron-accepting compound.

In the case where the foregoing 1,1,3-tris(2-methyl-4-hydroxy-5-tert-butylphenyl)butane and 1,1,3-tris(2-methyl-4-hydroxy-5-cyclohexylphenyl)butane are used together with other image stabilizer, the content of the foregoing 1,1,3-tris(2-methyl-4-hydroxy-5-tert-butylphenyl)butane or 1,1,3-tris(2-methyl-4-hydroxy-5-cyclohexylphenyl)butane (the total content in the case where the both are used together) is preferably at least 50% by mass, more preferably at least 70% by mass, and most preferably at least 90% by mass of the whole mass of the image stabilizers.

The thermosensitive color developing layer according to the second aspect of the invention contains at least one selected from 1,1,3-tris(2-methyl-4-hydroxy-5-tert-butylphenyl)butane and 1,1,3-tris(2-methyl-4-hydroxy-5-cyclohexylphenyl)butane as the image stabilizer. By containing such an image stabilizer, not only the background fogging can be improved but also the preservability of the image portions can be further enhanced due to mutual action with 4-hydroxybenzenesulfone anilide as the electron-accepting compound and 2-benzyloxynaphthalene and stearic acid amide as the sensitizer.

The foregoing 1,1,3-tris(2-methyl-4-hydroxy-5-tert-butylphenyl)butane and 1,1,3-tris(2-methyl-4-hydroxy-5-cyclohexylphenyl)butane may be used alone or in admixture.

Further, in the thermosensitive recording material according to the second aspect of the invention, a known image stabilizer other than the foregoing 1,1,3-tris(2-methyl-4-hydroxy-5-tert-butylphenyl)butane or 1,1,3-tris(2-methyl-4-hydroxy-5-cyclohexylphenyl)butane may be used together therewith. In the case where a known image stabilizer is used together, the content of the foregoing 1,1,3-tris(2-methyl-4-hydroxy-5-tert-butylphenyl)butane or 1,1,3-tris(2-methyl-4-hydroxy-5-cyclohexylphenyl)butane is preferably at least 50% by mass, and more preferably at least 70% by mass of the whole mass of the image stabilizers.

In the second aspect, phenol compounds, especially hindered phenol compounds are effective as the known image stabilizer. Examples thereof include 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

In the first and third to fifth aspects, the total amount of the image stabilizer to be used is preferably from 100 to 300 parts by mass, more preferably from 150 to 300 parts by mass, and most preferably from 200 to 250 parts by mass based on 100 parts by mass of the electron-donating colorless dye from the viewpoints of more effectively exhibiting the desired effects in background fogging and image preservability.

In the second aspect, the total amount of the image stabilizer to be used is preferably from 10 to 100 parts by mass, more preferably from 20 to 60 parts by mass, and most preferably from 25 to 50 parts by mass based on 100 parts by mass of the electron-donating colorless dye from the viewpoints of more effectively exhibiting the desired effects in background fogging and image preservability.

(UV Absorbent)

Further, so far as the effects of the invention are not hindered, the thermosensitive recording material of the invention may contain a UV absorbent in the thermosensitive color developing layer. Examples of the UV absorbent that can be used in the invention include those given below.

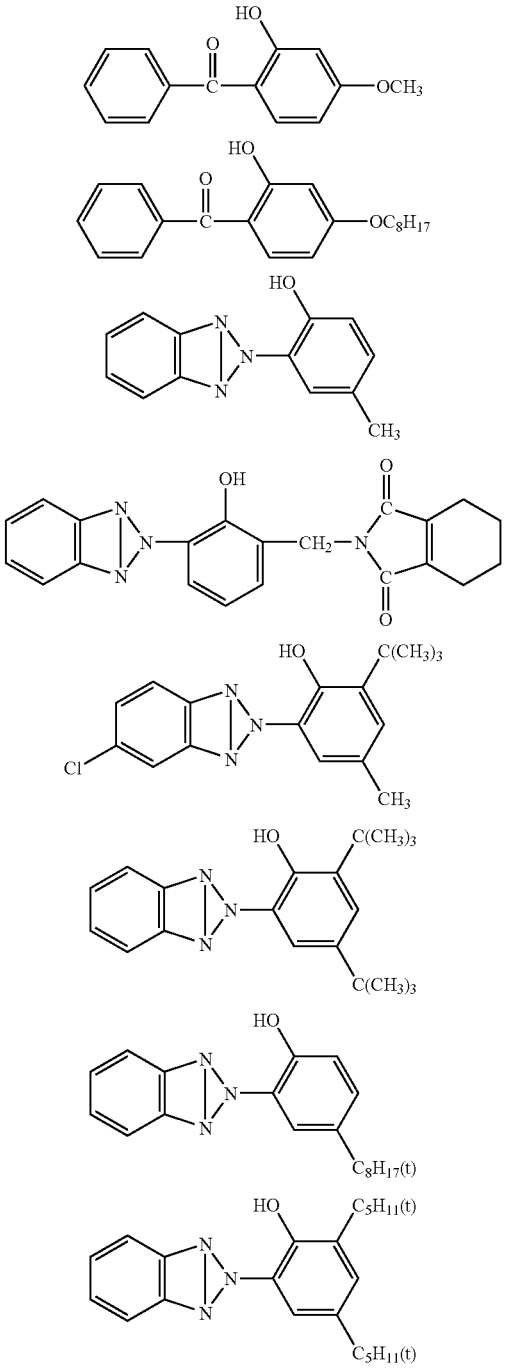

-continued

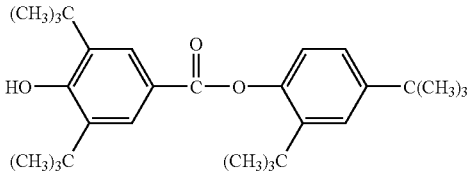

In the invention, dispersion of the electron-donating colorless dye, electron-accepting compound and sensitizer can be performed in a water-soluble binder. The water-soluble binder to be used in this case is preferably a compound that is dissolved in an amount of at least 5% by mass in water at 25° C.

Specific examples of the water-soluble binder include polyvinyl alcohol, methyl cellulose, carboxymethyl cellulose, starches (including modified starches), gelatin, gum arabic, casein, and saponification products of a styrene-maleic anhydride copolymer.

The binder is used not only during the dispersion but also for the purpose of enhancing the coating film strength of the thermosensitive color developing layer. In order to achieve this purpose, a synthetic polymer latex binder such as styrene-butadiene copolymers, vinyl acetate copolymers, acrylonitrile-butadiene copolymers, methyl acrylate-butadiene copolymers, and polyvinylidene chloride can also be used together.

The foregoing electron-donating colorless dye, electron-accepting compound and sensitizer are dispersed simultaneously or separately by a stirrer or pulverizer such as a ball mill, an attritor, and a sand mill to prepare a coating solution. The coating solution may contain any pigment, metallic soap, wax, surfactant, antistatic agent, UV absorbent, defoaming agent, and fluorescent dye, if desired.

Examples of the pigment include calcium carbonate, barium sulfate, lithopone, agalmatolite, kaolin, calcined kaolin, amorphous silica, and aluminum hydroxide. Examples of the metallic soap include higher fatty acid metal salts such as zinc stearate, calcium stearate, and aluminum stearate.

Examples of the wax include paraffin wax, microcrystalline wax, carnauba wax, methylol stearamide, polyethylene wax, polystyrene wax, and fatty acid amide wax. These waxes may be used alone or in admixture. Examples of the surfactant include alkali metal salts of sulfosuccinic acid and fluorine-containing surfactants.

These materials are mixed and then applied onto the support. The application method is not particularly limited, but the mixture is applied by using, for example, an air knife coater, a roll coater, a blade coater, or a curtain coater, dried, subjected to smoothening processing by calendering, and then put into use. Especially, the method using a curtain coater is preferable in the invention.

Further, the application amount of the thermosensitive color developing layer is not limited, but is usually preferably from about 2 to 7 g/m$^2$ in terms of dry weight.

<Protective Layer>

If desired, a protective layer can be provided on the thermosensitive color developing layer. The protective layer can contain an organic or inorganic fine powder, a binder, a surfactant, and a heat-fusible substance. Examples of the fine powder include inorganic fine powders such as calcium carbonate, silica (including amorphous silica), zinc oxide, titanium oxide, aluminum hydroxide, zinc hydroxide, barium sulfate, clay, talc, and surface-processed calcium or silica; and organic fine powders such as urea-formalin resins, styrene/methacrylic acid copolymers, and polystyrene.

Examples of the binder that can be used in the protective layer include polyvinyl alcohol, carboxy-modified polyvinyl alcohol, vinyl acetate-acrylamide copolymers, silicon-modified polyvinyl alcohol, starches, modified starches, methyl cellulose, carboxymethyl cellulose, hydroxymethyl cellulose, gelatins, gum arabic, casein, styrene-maleic acid copolymer hydrolysates, polyacrylamide derivatives, polyvinylpyrrolidone, and latices such as a styrene-butadiene rubber latex, an acrylonitrile-butadiene rubber latex, a methyl acrylate-butadiene rubber latex, and a vinyl acetate emulsion.

Further, it is possible to add a waterproofing agent that crosslinks the binder component in the protective layer to further enhance preservability of the thermosensitive recording material. Examples of the waterproofing agent include water-soluble initial condensates such as N-methylolurea, N-methylolmelamine, and urea-formalin; dialdehyde compounds such as glyoxal and glutaraldehyde; inorganic crosslinking agents such as boric acid, borax, and colloidal silica; and polyamide epichlorohydrin.

EXAMPLES

The present invention will be specifically described below with reference to the following Examples, but the invention is not limited thereto. Further, all parts and percentages are parts by mass and % by mass, unless otherwise indicated.

Example 1

<<Formation of Thermosensitive Recording Material>>

<Preparation of Coating Solution for Thermosensitive Color Developing Layer>

(Preparation of Liquid Dispersion A-1 (Electron-donating Colorless Dye))

The following respective components were mixed in a ball mill while dispersing to obtain a dispersion A-1 having a mean particle size of 0.7 μm.

[Composition of Liquid Dispersion A-1]

| | |
|---|---|
| 2-Anilino-3-methyl-6-diethylaminofluorane: | 10 parts |
| 2.5% solution of polyvinyl alcohol (trade name: PVA-105, manufactured by Kuraray Co., Ltd.): | 50 parts |

(Preparation of Liquid Dispersion B-1 (Electron-accepting Compound))

The following respective components were mixed in a ball mill while dispersing to obtain a dispersion B-1 having a mean particle size of 0.7 μm.

[Composition of Liquid Dispersion B-1]

| | |
|---|---|
| 4-Hydroxybenzenesulfone anilide: | 20 parts |
| 2.5% solution of polyvinyl alcohol (trade name: PVA-105, manufactured by Kuraray Co., Ltd.): | 100 parts |

(Preparation of Liquid Dispersion C-1 (Sensitizer))

The following respective components were mixed in a ball mill while dispersing to obtain a dispersion C-1 having a mean particle size of 0.7 μm.

[Composition of Liquid Dispersion C-1]

| | |
|---|---|
| 2-Benzyloxynaphthalene: | 20 parts |
| 2.5% solution of polyvinyl alcohol (trade name: PVA-105, manufactured by Kuraray Co., Ltd.): | 100 parts |

(Preparation of Pigment Dispersion Liquid D-1)

The following respective components were mixed in a sand mill while dispersing to obtain a pigment dispersion D-1 having a mean particle size of 2.0 μm.

[Composition of Pigment Dispersion Liquid D-1]

| | |
|---|---|
| Light calcium carbonate: | 40 parts |
| Sodium polyacrylate: | 1 part |
| Distilled water: | 60 parts |

The compounds of the following composition were mixed to obtain a coating solution for thermosensitive color developing layer.

[Composition of Coating Solution for Thermosensitive Color Developing Layer]

| | |
|---|---|
| Liquid dispersion A-1: | 60 parts |
| Liquid dispersion B-1: | 120 parts |
| Liquid dispersion C-1: | 120 parts |
| Pigment dispersion liquid D-1: | 101 parts |
| 30% liquid dispersion of zinc stearate: | 15 parts |
| Paraffin wax (30%): | 15 parts |
| Sodium dodecylbenzenesulfonate (25%): | 4 parts |

(Preparation of Coating Solution for Undercoat Layer of Support)

The following respective components were stirred and mixed by a dissolver to obtain a dispersion.

| | |
|---|---|
| Calcined kaolin (oil absorption: 75 mL/100 g): | 100 parts |
| Sodium hexametaphosphate: | 1 part |
| Distilled water: | 110 parts |

20 parts of SBR (styrene-butadiene rubber latex) and 25 parts of oxidized starch (25%) were added to the resulting dispersion to obtain a coating solution for undercoat layer of support.

<Preparation of Thermosensitive Recording Material>

The thus obtained coating solution for undercoat layer of support was applied onto wood-free paper having a smoothness according to JIS-8119 of 150 seconds in an application amount (after drying) of 8 g/m$^2$ by a blade coater to form an undercoat layer. By providing the undercoat layer, the support had a smoothness according to JIS-8119 of 350 seconds. Subsequently, the foregoing coating solution for thermosensitive recording material was applied onto the undercoat layer in an application amount (after drying) of 4 g/m$^2$ by a curtain coater, followed by drying. The surface of the thus formed thermosensitive color developing layer was subjected to calendering processing and then a thermosensitive recording material was obtained.

Example 2

A thermosensitive recording material was prepared in the same manner as in Example 1 except that the amount of the liquid dispersion C-1 was changed from 120 parts to 90 parts.

Example 3

A thermosensitive recording material was prepared in the same manner as in Example 1 except that the amount of the liquid dispersion C-1 was changed from 120 parts to 240 parts.

Example 4

A thermosensitive recording material was prepared in the same manner as in Example 1 except that the 2-anilino-3-methyl-6-diethylaminofluorane of the liquid dispersion A-1 was changed to 2-anilino-3-methyl-6-(N-ethyl-N-isoamyl-amino)fluorane.

Example 5

A thermosensitive recording material was prepared in the same manner as in Example 1 except that the 2-anilino-3-methyl-6-diethylaminofluorane of the liquid dispersion A-1 was changed to 2-anilino-3-methyl-6-(N-ethyl-N-isopropyl-amino)fluorane.

Example 6

A thermosensitive recording material was prepared in the same manner as in Example 1 except that the amount of the liquid dispersion C-1 was changed from 120 parts to 60 parts.

Example 7

A thermosensitive recording material was prepared in the same manner as in Example 1 except that the amount of the liquid dispersion C-1 was changed from 120 parts to 300 parts.

Example 8

A thermosensitive recording material was prepared in the same manner as in Example 1 except that the 2-anilino-3-methyl-6-diethylaminofluorane of the liquid dispersion A-1 was changed to 2-anilino-3-methyl-6-dibutylaminofluorane.

Example 9

A thermosensitive recording material was prepared in the same manner as in Example 1 except that the thermosensitive color developing layer was applied and formed by an air knife coater.

Example 10

A thermosensitive recording material was prepared in the same manner as in Example 1 except that prior to subjecting the formed thermosensitive color developing layer to calendering processing, the following coating solution for protective layer was further applied onto the thermosensitive color developing layer in an amount (after drying) of 2 g/m$^2$ by a curtain coater and then dried to form a protective layer, and the surface of the protective layer was subjected to calendering processing.

(Preparation of Coating Solution for Protective Layer)

First of all, the following composition was dispersed by a sand mill to obtain a pigment dispersion having a mean particle size of 2 μm.

| | |
|---|---|
| Aluminum hydroxide (mean particle size: 1 μm) (trade name; Higilite H42, manufactured by Showa Denko K. K.): | 40 parts |
| Sodium polyacrylate: | 1 part |
| Water | 60 parts |

Separately, 60 parts of water was added to 200 parts of a 15% aqueous solution of urea phosphated starch (trade name: MS4600, manufactured by Nihon Shokuhinkako Co., Ltd.) and 200 parts of a 15% aqueous solution of polyvinyl alcohol (trade name: PVA-105, manufactured by Kuraray Co., Ltd.), and the resultant solution was mixed with the foregoing pigment dispersion. The resultant mixture was mixed with 25 parts of an emulsified dispersion of zinc stearate having a mean particle size of 0.15 μm (trade name: Hydrin F115, manufactured by Chukyo Yushi Co., Ltd.) and 125 parts of a 2% aqueous solution of 2-ethylhexyl sulfosuccinate sodium salt to obtain a coating solution for protective layer.

Example 11

A thermosensitive recording material was prepared in the same manner as in Example 1 except that the 2-benzyloxy-naphthalene as the sensitizer was changed to dimethylbenzyl oxalate.

Example 12

A thermosensitive recording material was prepared in the same manner as in Example 1 except that the 2-benzyloxy-naphthalene as the sensitizer was changed to m-terphenyl.

Example 13

A thermosensitive recording material was prepared in the same manner as in Example 1 except that the 2-benzyloxy-naphthalene as the sensitizer was changed to ethylene glycol tolyl ether.

Example 14

A thermosensitive recording material was prepared in the same manner as in Example 1 except that the 2-benzyloxy-naphthalene as the sensitizer was changed to p-benzylbiphenyl.

Example 15

A thermosensitive recording material was prepared in the same manner as in Example 1 except that the 2-benzyloxy-naphthalene as the sensitizer was changed to 1,2-diphenoxy-methylbenzene.

Example 16

A thermosensitive recording material was prepared in the same manner as in Example 1 except that the 2-benzyloxy-naphthalene as the sensitizer was changed to stearic acid amide.

Example 17

A thermosensitive recording material was prepared in the same manner as in Example 1 except that in the preparation of the pigment dispersion liquid D-1, 1 part of the sodium polyacrylate was changed to 3 parts of sodium hexametaphosphate, and the distilled water was changed to city water; and that in the preparation of the coating solution for thermosensitive color developing layer, 4 parts of the sodium dodecylbenzenesulfonate (25%) was changed to 20 parts of 2-ethylhexyl sulfosuccinate sodium salt (2%)

Comparative Example 1

A thermosensitive recording material was prepared in the same manner as in Example 1 except that the 4-hydroxybenzene-sulfone anilide as the electron-accepting compound was changed to bisphenol A.

Comparative Example 2

A thermosensitive recording material was prepared in the same manner as in Example 1 except that the 4-hydroxybenzenesulfone anilide as the electron-accepting compound was changed to p-N-benzylsulfamoylphenol (i.e., N-benzyl-4-hydroxybenzenesulfonamide) as described in JP-B No. 4-20792.

Comparative Example 3

A thermosensitive recording material was prepared in the same manner as in Example 1 except that the wood-free paper was changed to medium-quality paper having a smoothness, measured by JIS-8119, of 30 seconds. Incidentally, the support having provided thereon an undercoat layer had a smoothness, measured by JIS-8119, of 90 seconds.

Oken smoothness, contact angle and total ion concentration of $Na^+$ ions and $K^+$ ions of the thermosensitive recording materials obtained in Examples 1 to 16 and Comparative Examples 1 to 3 were measured by the methods as described previously. For the measurement of the contact angle, DAT1100 (trade name, manufactured by Fibro System ab) was used.

Example 18

<<Formation of Thermosensitive Recording Material>>

<Preparation of Coating Solution for Thermosensitive Color Developing Layer>

(Preparation of Liquid Dispersion A-2)

The following respective components were mixed in a ball mill while dispersing to obtain a liquid dispersion A-2 having a mean particle size of 0.7 μm.

[Composition of Liquid Dispersion A-2]

| | |
|---|---|
| 2-Anilino-3-methyl-6-diethylaminofluorane (electron-donating colorless dye): | 10 parts |
| 2.5% solution of polyvinyl alcohol (trade name: PVA-105, manufactured by Kuraray Co., Ltd.): | 50 parts |

( Preparation of Liquid Dispersion B-2)

The following respective components were mixed in a ball mill while dispersing to obtain a liqiud dispersion B-2 having a mean particle size of 0.7 μm.

[Composition of Liquid Dispersion B-2]

| | |
|---|---|
| 4-Hydroxybenzenesulfone anilide (electron-accepting compound): | 20 parts |
| 2.5% solution of polyvinyl alcohol (trade name: PVA-105, manufactured by Kuraray Co., Ltd.): | 100 parts |

(Preparation of Liquid Dispersion C-2)

The following respective components were mixed in a ball mill while dispersing to obtain a liquid dispersion C-2 having a mean particle size of 0.7 μm.

[Composition of Liquid Dispersion C-2]

| | |
|---|---|
| 2-Benzyloxynaphthalene (sensitizer): | 20 parts |
| 2.5% solution of polyvinyl alcohol (trade name: PVA-105, manufactured by Kuraray Co., Ltd.): | 100 parts |

(Preparation of Dispersion D-2)

The following respective components were mixed in a ball mill while dispersing to obtain a liquid dispersion D-2 having a mean particle size of 0.7 μm.

[Composition of Liquid Dispersion D-2]

| | |
|---|---|
| 1,1,3-Tris(2-methyl-4-hydroxy-5-tert-butylphenyl)butane (image stabilizer): | 5 parts |
| 2.5% solution of polyvinyl alcohol (trade name: PVA-105, manufactured by Kuraray Co., Ltd.): | 25 parts |

(Preparation of Pigment Dispersion Liquid E-2)

The following respective components were mixed in a sand mill while dispersing to obtain a pigment dispersion liquid E-2 having a mean particle size of 2.0 μm.

[Composition of Pigment Dispersion Liquid E-2]

| | |
|---|---|
| Light calcium carbonate: | 40 parts |
| Sodium polyacrylate: | 1 part |
| Distilled water: | 60 parts |

The compounds of the following composition were mixed to obtain a coating solution for thermosensitive color developing layer.

[Composition of Coating Solution for Thermosensitive Color Developing Layer]

| | |
|---|---|
| Liquid dispersion A-2: | 60 parts |
| Liquid dispersion B-2: | 120 parts |
| Liquid dispersion C-2: | 120 parts |
| Liquid dispersion D-2: | 30 parts |
| Pigment dispersion liquid E-2: | 101 parts |
| Emulsified liquid dispersion of Stearic acid amide (20%; sensitizer) | 50 parts |
| 30% liquid dispersion of zinc stearate: | 15 parts |
| Paraffin wax (30%): | 15 parts |
| Sodium dodecylbenzenesulfonate (25%): | 4 parts |

<Formation of Thermosensitive Recording Material>

The coating solution for undercoat layer of support was applied onto wood-free base paper having s Stockigt size of 10 seconds and a basis weight of 50 g/m$^2$ in an amount (after drying) of 8 g/m$^2$ by a blade coater and the undercoat layer was dried and subjected to calendering processing to prepare undercoated paper. Subsequently, the foregoing coating solution for thermosensitive recording material was applied onto the undercoat layer in an amount (after drying) of 4.5 g/m$^2$ by a curtain coater and the coating layer was dried. The surface of the thus formed thermosensitive color developing layer was subjected to calendering processing and a thermosensitive recording material of Example 18 was thus obtained.

Example 19

A thermosensitive recording material of Example 19 was obtained in the same manner as in Example 18 except that the amount of the liquid dispersion C-2 was changed from 120 parts to 150 parts and that the amount of the emulsified liquid dispersion of stearic acid amide (20%) was changed from 50 parts to 25 parts.

Example 20

A thermosensitive recording material of Example 20 was obtained in the same manner as in Example 18 except that the amount of the liquid dispersion C-2 was changed from 120 parts to 165 parts and that the amount of the emulsified liquid dispersion of stearic acid amide (20%) was changed from 50 parts to 12.5 parts.

Example 21

A thermosensitive recording material of Example 21 was obtained in the same manner as in Example 18 except that the amount of the liquid dispersion C-2 was changed from 120 parts to 75 parts and that the amount of the emulsified liquid dispersion of stearic acid amide (20%) was changed from 50 parts to 87.5 parts.

Example 22

A thermosensitive recording material of Example 22 was obtained in the same manner as in Example 18 except that the 1,1,3-tris(2-methyl-4-hydroxy-5-tert-but-yl-phenyl)butane of the liquid dispersion D-2 was changed to 1,1,3-tris (2-methyl-4-hydroxy-5-cyclohexylphenyl)butane.

Example 23

A thermosensitive recording material of Example 23 was obtained in the same manner as in Example 18 except that the amount of the liquid dispersion D-2 was changed from 30 parts to 10 parts.

Example 24

A thermosensitive recording material of Example 24 was obtained in the same manner as in Example 18 except that the amount of the liquid dispersion D-2 was changed from 30 parts to 50 parts.

Example 25

A thermosensitive recording material of Example 25 was obtained in the same manner as in Example 18 except that the amount of the liquid dispersion D-2 was changed from 30 parts to 3 parts.

Example 26

A thermosensitive recording material of Example 26 was obtained in the same manner as in Example 18 except that the coating solution for thermosensitive recording material was applied by an air knife coater.

Example 27

A thermosensitive recording material was obtained in the same manner as in Example 23 except that prior to subjecting the formed thermosensitive color developing layer to calendering processing, the following coating solution for protective layer was further applied onto the thermosensitive color developing layer in an amount (after drying) of 2 g/m$^2$ by a curtain coater and the resultant layer was dried to form a protective layer, and the surface of the protective layer was subjected to calendering processing.

(Preparation of Coating Solution for Protective Layer)

First of all, the following composition was dispersed with a sand mill to obtain a pigment dispersion having a mean particle size of 2 μm. Subsequently, 60 parts of water was added to 200 parts of a 15% aqueous solution of urea phosphated starch (trade name: MS4600, manufactured by Nihon Shokuhinkako Co., Ltd.) and 200 parts of a 15% aqueous solution of polyvinyl alcohol (a trade name: PVA-105, manufactured by Kuraray Co., Ltd.), and the resultant solution was mixed with the foregoing pigment dispersion. The resultant mixture was mixed with 25 parts of an emulsified dispersion of zinc stearate having a mean particle size of 0.15 μm (trade name: Hydrin F115, manufactured by Chukyo Yushi Co., Ltd.) and 125 parts of a 2% aqueous solution of 2-ethylhexyl sulfosuccinate sodium salt, to obtain a coating solution for protective layer.

[Composition of Coating Solution for Protective Layer]

| | |
|---|---|
| Aluminum hydroxide (mean particle size: 1 μm) (trade name: Higilite H42, manufactured by Showa Denko K.K.): | 40 parts |
| Sodium polyacrylate: | 1 part |
| Water: | 60 parts |

Comparative Example 4

A thermosensitive recording material of Comparative Example 4 was obtained in the same manner as in Example 18 except that the liquid dispersion D-2 was not used.

Comparative Example 5

A thermosensitive recording material of Comparative Example 5 was obtained in the same manner as in Example 18 except that the 4-hydroxybenzenesulfone anilide of the liquid dispersion B was changed to 2,2-bis(4-hydroxy-phenyl) -propane [bisphenol A].

Comparative Example 6

A thermosensitive recording material of Comparative Example 6 was obtained in the same manner as in Example 18 except that the 1,1,3-tris(2-methyl-4-hydroxy-5-tert-butylphenyl)butane of the liquid dispersion D was changed to 2,2'-methylenebis(4-methyl-6-tert-butylphenol).

Comparative Example 7

A thermosensitive recording material of Comparative Example 7 was obtained in the same manner as in Example 18 except that the 4-hydroxybenzenesulfone anilide as the electron-accepting compound was changed to N-benzyl-4-hydroxybenzenesulfonamide (i.e., p-N-benzylsulfamoylphenol).

Example 28

<<Formation of Thermosensitive Recording Material>>

<Preparation of Coating Solution for Thermosensitive Color Developing Layer>

(Preparation of Liquid Dispersion A-3 (Electron-providing Colorless Dye))

The following respective components were mixed in a ball mill while dispersing to obtain a liquid dispersion A-3 having a mean particle size of 0.7 μm.

[Composition of Liquid Dispersion A-3]

| | |
|---|---|
| 2-Anilino-3-methyl-6-di-n-butylaminofluorane: | 10 parts |
| 2.5% solution of polyvinyl alcohol (trade name: PVA-105, manufactured by Kuraray Co., Ltd.): | 50 parts |

(Preparation of Liquid Dispersion B-3 (Electron-accepting Compound))

The following respective components were mixed in a ball mill while dispersing to obtain a liquid dispersion B-3 having a mean particle size of 0.7 μm.

[Composition of Liquid Dispersion B-3]

| | |
|---|---|
| 4-Hydroxybenzenesulfone anilide: | 20 parts |
| 2.5% solution of polyvinyl alcohol (trade name: PVA-105, manufactured by Kuraray Co., Ltd.): | 100 parts |

(Preparation of Liquid Dispersion C-3 (Sensitizer))

The following respective components were mixed in a ball mill while dispersing to obtain a liquid dispersion C-3 having a mean particle size of 0.7 μm.

[Composition of Liquid Dispersion C-3]

| | |
|---|---|
| 2-Benzylnaphthyl ether (sensitizer): | 20 parts |
| 2.5% solution of polyvinyl alcohol (trade name: PVA-105, manufactured by Kuraray Co., Ltd.): | 100 parts |

(Preparation of Pigment Dispersion Liquid D-3)

The following respective components were mixed in a sand mill while dispersing to obtain a pigment dispersion liquid D-3 having a mean particle size of 2.0 μm.

[Composition of Pigment Dispersion D-3]

| | |
|---|---|
| Light calcium carbonate: | 40 parts |
| Sodium polyacrylate: | 1 part |
| Water: | 60 parts |

The compounds of the following composition were mixed to obtain a coating solution for thermosensitive color developing layer.

[Composition of coating Solution for Thermosensitive Color Developing Layer]

| | |
|---|---|
| Liquid dispersion A-3: | 60 parts |
| Liquid dispersion B-3: | 120 parts |
| Liquid dispersion C-3: | 120 parts |
| Pigment dispersion liquid D-3: | 101 parts |
| 30% liquid dispersion of zinc stearate: | 15 parts |
| Paraffin wax (30%): | 15 parts |
| Sodium dodecylbenzenesulfonate (25%): | 4 parts |

<Preparation of Coating Solution for Undercoat Layer of Support>

The following respective components were stirred and mixed by a dissolver to obtain a dispersion.

| | |
|---|---|
| Calcined kaolin (oil absorption: 75 mL/100 g): | 100 parts |
| Sodium hexametaphosphate: | 1 part |
| Water: | 110 parts |

20 parts of SBR (styrene-butadiene rubber latex) and 25 parts of oxidized starch (25%) were added to the resulting dispersion to obtain a coating solution for undercoat layer of support.

<Preparation of Coating Solution for Protective Layer>

First of all, the following composition was dispersed with a sand mill to obtain a pigment dispersion having a mean particle size of 2 μm.

| | |
|---|---|
| Aluminum hydroxide (mean particle size: 1 μm) (trade name: Higilite H42, manufactured by Showa Denko K.K.): | 40 parts |
| Sodium polyacrylate: | 1 part |
| Water: | 60 parts |

Separately, 60 parts of water was added to 200 parts of a 15% aqueous solution of urea phosphated starch (trade name: MS4600, manufactured by Nihon Shokuhinkako Co., Ltd.) and 200 parts of a 15% aqueous solution of polyvinyl alcohol (trade name: PVA-105, manufactured by Kuraray Co., Ltd.), and the resultant solution was then mixed with the foregoing pigment dispersion. The resultant mixture was mixed with 25 parts of an emulsified dispersion of zinc stearate having a mean particle size of 0.15 μm (trade name: Hydrin F115, manufactured by Chukyo Yushi Co., Ltd.) and 125 parts of a 2% aqueous solution of 2-ethylhexyl sulfosuccinate sodium salt, to obtain a coating solution for protective layer.

<Preparation of Thermosensitive Recording Material>

The coating solution for undercoat layer of support was applied onto wood-free base paper having a basis weight of 50 g/m$^2$ in an amount (after drying) of 8 g/m$^2$ by a blade coater and the coating layer was dried and subjected to calendering processing to prepare undercoated paper. Subsequently, the foregoing coating solution for thermosensitive recording material was applied onto the undercoat layer in an amount (after drying) of 4 g/m$^2$ by a curtain coater, and the foregoing coating solution for protective layer was applied onto the thermosensitive color developing layer in an amount (after drying) of 2 g/m$^2$ by a curtain coated, and the coating layer was dried. The surface of the thus formed protective layer was subjected to calendering processing to obtain a thermosensitive recording material according to Example 28.

Example 29

A thermosensitive recording material was prepared in the same manner as in Example 28 except that the 2-anilino-3-methyl-6-di-n-butylaminofluorane of the composition of the liquid dispersion A-3 was changed to 2-anilino-3-methyl-6-di-n-amylaminofluorane.

Example 30

A thermosensitive recording material was prepared in the same manner as in Example 28 except that the amount of the 4-hydroxybenzenesulfone anilide of the composition of the liquid dispersion B-3 was changed from 20 parts to 5 parts and that the amount of the liquid dispersion B-3 of the composition of the coating solution for thermosensitive color developing layer was changed from 120 parts to 105 parts.

Example 31

A thermosensitive recording material was prepared in the same manner as in Example 28 except that the amount of the 4-hydroxybenzenesulfone anilide of the composition of the liquid dispersion B-3 was changed from 20 parts to 10 parts and that the amount of the liquid dispersion B-3 of the composition of the coating solution for thermosensitive color developing layer was changed from 120 parts to 110 parts.

Example 32

A thermosensitive recording material was prepared in the same manner as in Example 28 except that the amount of the 4-hydroxybenzenesulfone anilide of the composition of the liquid dispersion B-3 was changed from 20 parts to 30 parts and that the amount of the liquid dispersion B-3 of the composition of the coating solution for thermosensitive color developing layer was changed from 120 parts to 130 parts.

Example 33

A thermosensitive recording material was prepared in the same manner as in Example 28 except that the 2-benzylnaphthyl ether of the composition of the liquid dispersion C-3 was changed to 1,2-bis(3-methylphenoxy)ethane.

Example 34

A thermosensitive recording material was prepared in the same manner as in Example 28 except that the 2-benzylnaphthyl ether of the composition of the liquid dispersion C-3 was changed to 1,2-diphenoxymethylbenzene.

Example 35

A thermosensitive recording material was prepared in the same manner as in Example 28 except that the 2-benzylnaphthyl ether of the composition of the liquid dispersion C-3 was changed to methylolstearamide.

Example 36

A thermosensitive recording material was prepared in the same manner as in Example 28 except that the amount of the 2-benzylnaphthyl ether of the composition of the liquid dispersion C-3 was changed from 20 parts to 10 parts and that the amount of the liquid dispersion C-3 of the composition of the coating solution for thermosensitive color developing layer was changed from 120 parts to 110 parts.

Example 37

A thermosensitive recording material was prepared in the same manner as in Example 28 except that the amount of the 2-benzylnaphthyl ether of the composition of the liquid dispersion C-3 was changed from 20 parts to 30 parts and that the amount of the liquid dispersion C-3 of the composition of the coating solution for thermosensitive color developing layer was changed from 120 parts to 130 parts.

Comparative Example 8

A thermosensitive recording material was prepared in the same manner as in Example 28 except that the 4-hydroxybenzenesulfone anilide of the composition of the liquid dispersion B-3 was changed to bisphenol A.

Comparative Example 9

A thermosensitive recording material was prepared in the same manner as in Example 28 except that the 4-hydroxybenzenesulfone anilide of the composition of the liquid dispersion B-3 was changed to N-benzyl-4-hydroxybenzenesulfonamide.

Comparative Example 10

A thermosensitive recording material was prepared in the same manner as in Example 28 except that the 2-anilino-3-methyl-6-di-n-butylaminofluorane of the composition of the liquid dispersion A-3 was changed to 2-anilino-3-methyl-6-(N-cyclohexyl-N-methyl)aminofluorane.

Comparative Example 11

A thermosensitive recording material was prepared in the same manner as in Example 28 except that the 2-anilino-3-methyl-6-di-n-butylaminofluorane of the composition of the liquid dispersion A-3 was changed to 3-dimethylamino-6-methyl-7-(m-toluidino)-fluorane.

Example 38

<<Formation of Thermosensitive Recording Material>>

<Preparation of Coating Solution for Thermosensitive Color Developing Layer>

(Preparation of Liquid Dispersion A-4 (Electron-donating Colorless Dye))

The following respective components were mixed in a ball mill while dispersing to obtain a liquid dispersion A-4 having a mean particle size of 0.7 μm.

[Composition of Liquid Dispersion A-4]

| | |
|---|---|
| 2-Anilino-3-methyl-6-(N-ethyl-N-p-benzyl) aminofluorane: | 10 parts |
| 2.5% solution of polyvinyl alcohol (trade name: PVA-105, manufactured by Kuraray Co., Ltd.): | 50 parts |

(Preparation of Liquid Dispersion B-4 (Electron-accepting Compound))

The following respective components were mixed in a ball mill while dispersing to obtain a liquid dispersion B-4 having a mean particle size of 0.7 μm.

[Composition of Liquid Dispersion B-4]

| | |
|---|---|
| 4-Hydroxybenzenesulfone anilide: | 20 parts |
| 2.5% solution of polyvinyl alcohol (trade name: PVA-105, manufactured by Kuraray Co., Ltd.): | 100 parts |

(Preparation of Liquid Dispersion C-4 (Sensitizer))

The following respective components were mixed in a ball mill while dispersing to obtain a liquid dispersion C-4 having a mean particle size of 0.7 μm.

[Composition of Liquid Dispersion C-4]

| | |
|---|---|
| 2-Benzylnaphthyl ether (sensitizer): | 20 parts |
| 2.5% solution of polyvinyl alcohol (trade name: PVA-105, manufactured by Kuraray Co., Ltd.): | 100 parts |

(Preparation of Pigment Dispersion Liquid D-4)

The following respective components were mixed in a sand mill while dispersing to obtain a pigment dispersion liquid D-4 having a mean particle size of 2.0 μm.

[Composition of Pigment Dispersion Liquid D-4]

| | |
|---|---|
| Light calcium carbonate: | 40 parts |
| Sodium polyacrylate: | 1 part |
| Water: | 60 parts |

The compounds of the following composition were mixed to obtain a coating solution for thermosensitive color developing layer.

[Composition of Coating Solution for Thermosensitive Color Developing Layer]

| | |
|---|---|
| Liquid dispersion A-4: | 60 parts |
| Liquid dispersion B-4: | 120 parts |
| Liquid dispersion C-4: | 120 parts |
| Pigment dispersion liquid D-4: | 101 parts |
| 30% liquid dispersion of zinc stearate: | 15 parts |
| Paraffin wax (30%): | 15 parts |
| Sodium dodecylbenzenesulfonate (25%): | 4 parts |

<Preparation of Coating Solution for Undercoat Layer of Support>

The following respective components were stirred and mixed by a dissolver to obtain a liquid dispersion.

| | |
|---|---|
| Calcined kaolin (oil absorption: 75 mL/100 g): | 100 parts |
| Sodium hexametaphosphate: | 1 part |
| Water: | 110 parts |

20 parts of SBR (styrene-butadiene rubber latex) and 25 parts of oxidized starch (25%) were added to the resulting liquid dispersion to obtain a coating solution for undercoat layer of support.

<Preparation of Coating Solution for Protective Layer>

First of all, the following composition was dispersed with a sand mill to obtain a pigment dispersion having a mean particle size of 2 μm.

| | |
|---|---|
| Aluminum hydroxide (mean particle size: 1 μm) (trade name: Higilite H42, manufactured by Showa Denko K.K.): | 40 parts |
| Sodium polyacrylate: | 1 part |
| Water: | 60 parts |

Separately, 60 parts of water was added to 200 parts of a 15% aqueous solution of urea phosphated starch (trade name: MS4600, manufactured by Nihon Shokuhinkako Co., Ltd.) and 200 parts of a 15% aqueous solution of polyvinyl alcohol (trade name: PVA-105, manufactured by Kuraray Co., Ltd.), and the resultant solution was then mixed with the foregoing pigment dispersion. The resultant mixture was mixed with 25 parts of an emulsified dispersion of zinc stearate having a mean particle size of 0.15 μm (trade name: Hydrin F115, manufactured by Chukyo Yushi Co., Ltd.) and 125 parts of a 2% aqueous solution of 2-ethylhexyl sulfosuccinate sodium salt, to obtain a coating solution for protective layer.

<Preparation of Thermosensitive Recording Material>

The coating solution for undercoat layer of support was applied onto wood-free base paper having a basis weight of 50 g/m$^2$ in an amount (after drying) of 8 g/m$^2$ by a blade coater and the coating layer was dried and subjected to calendering processing to prepare undercoated paper. Subsequently, the foregoing coating solution for thermosensitive recording material was applied onto the undercoat layer in an amount (after drying) of 4 g/m$^2$ by a curtain coater, and the foregoing coating solution for protective layer was applied onto the thermosensitive color developing layer in an amount (after drying) of 2 g/m$^2$ by a curtain coated, and the coating layers were dried. The surface of the thus formed protective layer was subjected to calendering processing to obtain a thermosensitive recording material according to Example 38.

Example 39

A thermosensitive recording material was prepared in the same manner as in Example 38 except that the amount of the 4-hydroxybenzenesulone anilide of the composition of the liquid dispersion B-4 was changed from 20 parts to 10 parts and that the amount of the liquid dispersion B-4 of the composition of the coating solution for thermosensitive color developing layer was changed from 120 parts to 110 parts.

Example 40

A thermosensitive recording material was prepared in the same manner as in Example 38 except that the amount of the 4-hydroxybenzenesulone anilide of the composition of the liquid dispersion B-4 was changed from 20 parts to 30 parts and that the amount of the liquid dispersion B-4 of the composition of the coating solution for thermosensitive color developing layer was changed from 120 parts to 130 parts.

Example 41

A thermosensitive recording material was prepared in the same manner as in Example 38 except that the 2-benzylnaphthyl ether of the composition of the liquid dispersion C-4 was changed to 1,2-bis(3-methylphenoxy)ethane.

Example 42

A thermosensitive recording material was prepared in the same manner as in Example 38 except that the 2-benzylnaphthyl ether of the composition of the liquid dispersion C-4 was changed to 1,2-diphenoxymethylbenzene.

Example 43

A thermosensitive recording material was prepared in the same manner as in Example 38 except that the 2-benzylnaphthyl ether of the composition of the liquid dispersion C-4 was changed to methylolstearamide.

Example 44

A thermosensitive recording material was prepared in the same manner as in Example 38 except that the amount of the 4-hydroxybenzenesulfone anilide of the composition of the liquid dispersion B-4 was changed from 20 parts to 5 parts and that the amount of the liquid dispersion B-4 of the composition of the coating solution for thermosensitive color developing layer was changed from 120 parts to 105 parts.

Example 45

A thermosensitive recording material was prepared in the same manner as in Example 38 except that the amount of the 2-benzylnaphthyl ether of the composition of the liquid dispersion C-4 was changed from 20 parts to 10 parts and that the amount of the liquid dispersion C-4 of the composition of the coating solution for thermosensitive color developing layer was changed from 120 parts to 110 parts.

Example 46

A thermosensitive recording material was prepared in the same manner as in Example 38 except that the amount of the 2-benzylnaphthyl ether of the composition of the liquid dispersion C-4 was changed from 20 parts to 30 parts and that the amount of the liquid dispersion C-4 of the composition of the coating solution for thermosensitive color developing layer was changed from 120 parts to 130 parts.

Comparative Example 12

A thermosensitive recording material was prepared in the same manner as in Example 38 except that the 4-hydroxybenzenesulfone anilide of the composition of the liquid dispersion B-4 was changed to bisphenol A.

Comparative Example 13

A thermosensitive recording material was prepared in the same manner as in Example 38 except that the 4-hydroxybenzenesulfone anilide of the composition of the liquid dispersion B-4 was changed to N-benzyl-4-hydroxybenzenesulfonamide.

Comparative Example 14

A thermosensitive recording material was prepared in the same manner as in Example 38 except that the 2-anilino-3-methyl-6-(N-ethyl-N-p-benzyl)aminofluorane of the composition of the liquid dispersion A-4 was changed to 2-anilino-3-methyl-6-(N-cyclohexyl-N-methyl)aminofluorane.

Comparative Example 15

A thermosensitive recording material was prepared in the same manner as in Example 38 except that the 2-anilino-3-methyl-6-(N-ethyl-N-p-benzyl)aminofluorane of the composition of the liquid dispersion A-4 was changed to 3-dimethylamino-6-methyl-7-(m-toluidino)-fluorane.

Example 47

<<Formation of Thermosensitive Recording Material>>

<Preparation of Coating Solution for Thermosensitive Color Developing Layer>

(Preparation of Liquid Dispersion A-5 (Electron-donating Colorless Dye))

The following respective components were mixed in a ball mill while dispersing to obtain a liquid dispersion A-5 having a mean particle size of 0.7 μm.

[Composition of Liquid Dispersion A-5]

| | |
|---|---|
| 2-Anilino-3-methyl-6-di-n-butylaminofluorane (electron-donating colorless dye): | 10 parts |
| 2.5% solution of polyvinyl alcohol (trade name: PVA-105, manufactured by Kuraray Co., Ltd.): | 50 parts |

(Preparation of Liquid Dispersion B-5 (Electron-accepting Compound))

The following respective components were mixed in a ball mill while dispersing to obtain a liquid dispersion B-5 having a mean particle size of 0.7 μm.

[Composition of Liquid Dispersion B-5]

| | |
|---|---|
| 4-Hydroxybenzenesulfone anilide (electron-accepting compound): | 20 parts |
| 2.5% solution of polyvinyl alcohol (trade name: PVA-105, manufactured by Kuraray Co., Ltd.): | 100 parts |

(Preparation of Liquid Dispersion C-5 (Sensitizer))

The following respective components were mixed in a ball mill while dispersing to obtain a liquid dispersion C-5 having a mean particle size of 0.7 μm.

[Composition of Liquid Dispersion C-5]

| | |
|---|---|
| 2-Benzyloxynaphthalene (sensitizer): | 20 parts |
| 2.5% solution of polyvinyl alcohol (trade name: PVA-105, manufactured by Kuraray Co., Ltd.): | 100 parts |

(Preparation of Liquid Dispersion D-5 (Image Stabilizer))

The following respective components were mixed in a ball mill while dispersing to obtain a liquid dispersion D-5 having a mean particle size of 0.7 μm.

[Composition of Liquid Dispersion D-5]

| | |
|---|---|
| 1,1,3-Tris(2-methyl-4-hydroxy-5-tert-butyl-phenyl)butane (image stabilizer): | 5 parts |
| 2.5% solution of polyvinyl alcohol (trade name: PVA-105, manufactured by Kuraray Co., Ltd.): | 25 parts |

(Preparation of Pigment Dispersion Liquid E-5)

The following respective components were mixed in a sand mill while dispersing to obtain a pigment dispersion liquid E-5 having a mean particle size of 2.0 μm.

[Composition of Pigment Dispersion Liquid E-5]

| | |
|---|---|
| Light calcium carbonate: | 40 parts |
| Sodium polyacrylate: | 1 part |
| Water: | 60 parts |

The compounds of the following composition were mixed to obtain a coating solution for thermosensitive color developing layer.

[Composition of Coating Solution for Thermosensitive Color Developing Layer]

| | |
|---|---|
| Liquid dispersion A-5: | 60 parts |
| Liquid dispersion B-5: | 120 parts |
| Liquid dispersion C-5: | 120 parts |
| Liquid dispersion D-5: | 30 parts |
| Pigment dispersion liquid E-5: | 101 parts |
| Emulsified liquid dispersion of stearic acid amide (20%; sensitizer) | 50 parts |
| 30% liquid dispersion of zinc stearate: | 15 parts |
| Paraffin wax (30%): | 15 parts |
| Sodium dodecylbenzenesulfonate (25%): | 4 parts |

<Preparation of Coating Solution for Undercoat Layer of Support>

The following respective components were stirred and mixed by a dissolver to obtain a liquid dispersion.

| | |
|---|---|
| Calcined kaolin (oil absorption: 75 mL/100 g): | 100 parts |
| Sodium hexametaphosphate: | 1 part |
| Water: | 110 parts |

20 parts of SBR (styrene-butadiene rubber latex) and 25 parts of oxidized starch (25%) were added to the resulting liquid dispersion to obtain a coating solution for undercoat layer of support.

<Preparation of Coating Solution for Protective Layer>

First of all, the following composition was dispersed with a sand mill to obtain a pigment dispersion having a mean particle size of 2 μm.

| | |
|---|---|
| Aluminum hydroxide (mean particle size: 1 μm) (trade name: Higilite H42, manufactured by Showa Denko K. K.): | 40 parts |
| Sodium polyacrylate: | 1 part |
| Water: | 60 parts |

Separately, 60 parts of water was added to 200 parts of a 15% aqueous solution of urea phosphated starch (trade name: MS4600, manufactured by Nihon Shokuhinkako Co., Ltd.) and 200 parts of a 15% aqueous solution of polyvinyl alcohol (trade name: PVA-105, manufactured by Kuraray Co., Ltd.), and the resultant solution was then mixed with the foregoing pigment dispersion. The resultant mixture was mixed with 25 parts of an emulsified dispersion of zinc stearate having a mean particle size of 0.15 μm (trade name: Hydrin F115, manufactured by Chukyo Yushi Co., Ltd.) and 125 parts of a 2% aqueous solution of 2-ethylhexyl sulfosuccinate sodium salt, to obtain a coating solution for protective layer.

<Preparation of Thermosensitive Recording Material>

The coating solution for undercoat layer of support was applied onto wood-free base paper having a basis weight of 50 g/m$^2$ in an amount (after drying) of 8 g/m$^2$ by a blade coater and the coating layer was dried and subjected to calendering processing to prepare undercoated paper. Subsequently, the foregoing coating solution for thermosensitive recording material was applied onto the undercoat layer in an amount (after drying) of 4 g/m$^2$ by a curtain coater, and the foregoing coating solution for protective layer was applied onto the thermosensitive color developing layer in an amount (after drying) of 2 g/m$^2$ by a curtain coated, and the coating layers were dried. The surface of the thus formed protective layer was subjected to calendering processing to obtain a thermosensitive recording material according to Example 47.

Example 48

A thermosensitive recording material was prepared in the same manner as in Example 47 except that the 2-anilino-3-methyl-6-di-n-butylaminofluorane of the composition of the liquid dispersion A-5 was changed to 2-anilino-3-methyl-6-di-n-amylaminofluorane.

Example 49

A thermosensitive recording material was prepared in the same manner as in Example 47 except that the 2-anilino-3-methyl-6-di-n-butylaminofluorane of the composition of the liquid dispersion A-5 was changed to 2-anilino-3-methyl-6-(N-ethyl-N-p-benzyl)aminofluorane.

Example 50

A thermosensitive recording material was prepared in the same manner as in Example 47 except that the 1,1,3-tris(2-methyl-4-hydroxy-5-tert-butylphenyl)butane of the composition of the liquid dispersion D-5 was changed to 1,1,3-tris(2-methyl-4-hydroxy-5-cyclohexylphenyl)butane.

Example 51

A thermosensitive recording material was prepared in the same manner as in Example 47 except that the amount of the 1,1,3-tris(2-methyl-4-hydroxy-5-tert-butylphenyl)butane of the composition of the liquid dispersion D-5 was changed from 5 parts to 1 part and that the amount of the liquid dispersion D-5 of the composition of the coating solution for thermosensitive color developing layer was changed from 30 parts to 26 parts.

Example 52

A thermosensitive recording material was prepared in the same manner as in Example 47 except that the amount of the 1,1,3-tris(2-methyl-4-hydroxy-5-tert-butylphenyl)butane of the composition of the liquid dispersion D-5 was changed from 5 parts to 10 parts and that the amount of the liquid dispersion D-5 of the composition of the coating solution for thermosensitive color developing layer was changed from 30 parts to 35 parts.

Example 53

A thermosensitive recording material was prepared in the same manner as in Example 47 except that the amount of the 1,1,3-tris(2-methyl-4-hydroxy-5-tert-butylphenyl)butane of the composition of the liquid dispersion D-5 was changed from 5 parts to 20 parts and that the amount of the liquid dispersion D-5 of the composition of the coating solution for thermosensitive color developing layer was changed from 30 parts to 45 parts.

Comparative Example 16

A thermosensitive recording material was prepared in the same manner as in Example 47 except that the 4-hydroxybenzenesulfone anilide of the composition of the liquid dispersion B-5 was changed to bisphenol A.

Comparative Example 17

A thermosensitive recording material was prepared in the same manner as in Example 53 except that the 4-hydroxybenzenesulfone anilide of the composition of the liquid dispersion B-5 was changed to N-benzyl-4-hydroxybenzenesulfonamide.

Example 54

A thermosensitive recording material was prepared in the same manner as in Example 47 except that the 2-anilino-3-methyl-6-di-n-butylaminofluorane of the composition of the liquid dispersion A-5 was changed to 2-anilino-3-methyl-6-(N-cyclohexyl-N-methyl)aminofluorane.

Example 55

A thermosensitive recording material was prepared in the same manner as in Example 47 except that the amount of the liquid dispersion D-5 of the composition of the coating solution for thermosensitive color developing layer was changed to 0 part (i.e., not used).

<<Evaluation of Thermosensitive Recording Material>>

With respect to Examples 1 to 17 and Comparative Examples 1 to 3, sensitivity, background fogging, image preservability, chemical resistance, printing trouble due to friction between a head and the recording material, and adaptability to inkjet printing were evaluated. With respect to Examples 18 to 27 and Comparative Examples 4 to 7, sensitivity, background fogging, image preservability, chemical resistance, sticking properties, and resistance to inkjet inks were evaluated. With respect to Examples 28 to 37 and Comparative Examples 8 to 11, sensitivity, background fogging, image preservability, chemical resistance, and adaptability to inkjet printing were evaluated. With respect to Examples 38 to 46 and Comparative Examples 12 to 15, sensitivity, background fogging, image preservability, background light fastness, chemical resistance, and adaptability to inkjet printing were evaluated. With respect to Examples 47 to 55 and Comparative Examples 16 and 17, sensitivity, background fogging, image preservability, chemical resistance, anti-sticking properties, and adaptability to inkjet printing were evaluated. The results are shown in Tables 1 to 5. Each of evaluation methods is as follows.

(1) Sensitivity

Printing was performed using a thermosensitive printing device having a thermal head (trade name: KJT-216-8MPD1, manufactured by Kyocera Corporation) and pressure rolls of 100 kg/cm$^2$ just before the head. The printing was carried out at a pulse width of 1.5 ms under conditions of a head voltage of 24 V and a pulse frequency of 10 ms, and printing density was measured by a Macbeth reflection densitometer (RD-918).

(2) Background Fogging

With respect to each of the thermosensitive recording materials, density of background after being allowed to stand in an environment at 60° C. and at a relative humidity of 20% for 24 hours was measured by a Macbeth reflection densitometer (RD-918). The lower the numerical value is, the better the result is.

(3) Image Preservability

An image was recorded on each of the thermosensitive recording materials with the same device and under the same conditions as in the above-described item (1), and image density immediately after printing was measured by a Macbeth reflection densitometer (RD-918). Thereafter, the thermosensitive recording materials recording the image were allowed to stand in an atmosphere at 60° C. and at a relative humidity of 20% for 24 hours, and then image density was measured by a Macbeth reflection densitometer (RD-918). A rate (image retention rate) of the image density after being allowed to stand to the image density immediately after printing was calculated by the following equation. The higher the numerical value is, the better the image preservability is.

Image retention rate=[(Image density after being allowed to stand under the foregoing conditions)/(Image density immediately after printing)]×100

(4) Chemical Resistance

An image was printed on each of the thermosensitive recording materials under the same conditions as in the above-described item (1), and another image was written on the surfaces of the background and printed portions thereof with a fluorescent pen (trade name: Zebra Fluorescent Pen 2-Pink, manufactured by Zebra Co., Ltd.). One day after the another image was written, the state of generation of background fogging and the stability of the image portions of the thermosensitive recording materials were visually observed and evaluated according to the following criteria.

[Criteria]

A: Generation of fogging was not observed, and change of the image portions was not observed.

B: Generation of fogging was slightly observed, and color of the image portions slightly faded.

C: Generation of fogging was remarkably observed, and color of the image portions substantially faded.

(5) Evaluation of Printing Trouble Due to Friction Between a Head and the Recording Material A test chart at a printing rate of 20% was printed on 1,000 A4-size sheets with a word processor (trade name: Toshiba Rupo 95JV, manufactured by Toshiba Corporation). At that time, the number of missing dots was evaluated.

(6) Evaluation of Adaptability to Inkjet Printing:

Red letters were printed on each of the thermosensitive recording materials in a superfine mode with an inkjet printer (trade name: MJ930, manufactured by Seiko Epson Corporation) and the color (fogging) of the printed letters and optionally the state of blotting were evaluated.

(1) Fogging

A: Vivid red

B: Dull red

C: Dark red rather than red (2) Blotting:

A: The letters could be clearly read.

B: The letters blotted, but there was no problem in reading.

C: The letters blotted and could be barely read.

D: The letters blotted and could not be read.

(7) Sticking Properties

An image was printed on each of the thermosensitive recording materials with a facsimile machine (trade name: SFX 85, manufactured by Sanyo Electric co., Ltd.) and No. 3 Chart of The Electronic Imaging Society of Japan as a test chart. At that time, a printing sound and the state of missing of the image as visually measured were evaluated according to the following criteria.

[Criteria]

A: Noise other than the printing sound was not generated, and missing of the image was not observed.

B: A noise was slightly generated, and missing of the image was observed.

C: A clear noise (sticking sound) was generated, and missing of the image was largely observed.

(8) Resistance to Inkjet Inks

An image obtained by high-image quality printing with an inkjet printer (trade name: MJ930C, manufactured by Seiko Epson Corporation) was brought into contact with the surface of each of the thermosensitive recording materials on which an image had been printed in the same manner as in the case of evaluation of sensitivity as described above, and was allowed to stand at 25° C. for 48 hours. Thereafter, image density was measured by a Macbeth reflection densitometer (RD-918). The image density of a non-treated thermosensitive recording material was also measured. A rate (remaining rate) of the image density of the treated thermosensitive recording material to that of non-treated thermosensitive recording material was calculated. The higher the numerical value is, the better the resistance to inkjet inks is.

(9) Background Light Fastness

Each of the thermosensitive recording materials was directly exposed to sunlight (500,000 lux·h (as measured by a digital illumination photometer, T-1 (trade name) manufactured by Minolta Co., Ltd.)). Thereafter, the density of the background of each thermosensitive recording material was measured by a Macbeth reflection densitometer (RD-918). The lower the numerical value is, the better the result is.

TABLE 1

| | Smoothness | Contact angle (Degree) | Ion concentration (ppm) | Sensitivity | Fogging | Image preservability (%) | Chemical resistance | *1 (Number) | Inkjet fogging | Inkjet blotting |
|---|---|---|---|---|---|---|---|---|---|---|
| Example 1 | 720 | 25 | 780 | 1.31 | 0.09 | 93 | A | 0 | A | B |
| Example 2 | 750 | 27 | 760 | 1.28 | 0.09 | 91 | A | 0 | A | B |
| Example 3 | 730 | 27 | 790 | 1.29 | 0.10 | 87 | A | 0 | A | B |
| Example 4 | 720 | 28 | 770 | 1.28 | 0.10 | 90 | A | 0 | A | B |
| Example 5 | 750 | 29 | 760 | 1.28 | 0.08 | 86 | A | 0 | A | B |
| Example 6 | 700 | 35 | 780 | 1.23 | 0.10 | 77 | A | 0 | A | B |
| Example 7 | 650 | 38 | 790 | 1.24 | 0.09 | 86 | A | 0 | A | B |
| Example 8 | 710 | 29 | 770 | 1.28 | 0.09 | 68 | A | 0 | A | B |
| Example 9 | 700 | 28 | 740 | 1.28 | 0.09 | 85 | A | 0 | A | B |
| Example 10 | 730 | 60 | 790 | 1.28 | 0.09 | 85 | A | 0 | A | A |
| Example 11 | 750 | 28 | 720 | 1.29 | 0.10 | 86 | A | 0 | A | B |
| Example 12 | 780 | 31 | 780 | 1.29 | 0.10 | 84 | A | 0 | A | B |
| Example 13 | 720 | 29 | 790 | 1.30 | 0.09 | 87 | A | 0 | A | B |
| Example 14 | 700 | 28 | 770 | 1.27 | 0.10 | 82 | A | 0 | A | B |
| Example 15 | 660 | 35 | 780 | 1.22 | 0.12 | 72 | A | 0 | A | B |
| Example 16 | 600 | 17 | 1080 | 1.27 | 0.08 | 85 | A | 1 | A | C |
| Comparative Example 1 | 720 | 28 | 790 | 1.21 | 0.10 | 70 | C | 0 | C | B |
| Comparative Example 2 | 700 | 26 | 780 | 1.15 | 0.10 | 60 | A | 0 | C | B |
| Comparative Example 3 | 200 | 28 | 770 | 1.10 | 0.09 | 80 | A | 0 | A | B |

Note)

*1 Printing trouble due to friction between a head and a recording material

It can be understood from Table 1 that the thermosensitive recording materials obtained in Examples 1 to 16 of the invention are superior in sensitivity, background fogging, storage stability of colored images, chemical resistance and prevention of printing trouble due to friction between a head and a recording material, and have adaptability to inkjet recording. On the other hand, the thermosensitive recording material obtained in Comparative Example 1 in which bisphenol A was used as the electron-accepting compound is inferior in sensitivity, image preservability, chemical resistance and inkjet fogging. Further, the thermosensitive recording material obtained in Comparative Example 2 in which a sulfonamide compound different from the sulfonamide compound used in the invention was used is inferior in inkjet fogging in addition to sensitivity and image preservability. In addition, the thermosensitive recording material obtained in Comparative Example 3 in which the thermosensitive recording surface had an Oken smoothness of 200 seconds is extremely poor in sensitivity.

It can be understood from Table 3 that the thermosensitive recording materials obtained in Examples 28 to 37 of the invention are superior in any of sensitivity, background fogging, storage stability of colored images, chemical resistance and adaptability to inkjet recording (fogging). On the other hand, the thermosensitive recording material obtained in Comparative Example 8 in which bisphenol A was used as the electron-accepting compound was not satisfactory from the viewpoints of sensitivity, image preservability, chemical resistance and inkjet fogging; and the thermosensitive recording material obtained in Comparative Example 9 in which N-benzyl-4-hydroxybenzenesulfonamide was used as the electron-accepting compound was not satisfactory from the viewpoints of sensitivity, image preservability and inkjet fogging. Further, the thermosensitive recording material obtained in Comparative Example 10 in which 2-anilino-3-methyl-6-(N-cyclohexyl-N-methyl)aminofluorane was used as the electron-donating colorless dye and the thermosensitive recording material obtained in Comparative Example 11 in which 3-dimethylamino-6-methyl-7-(m-

TABLE 2

| | Sensitivity | Background fogging | Image retention rate | Chemical resistance | Sticking properties | Resistance to inkjet inks |
|---|---|---|---|---|---|---|
| Example 18 | 1.31 | 0.09 | 98% | A | A | 95% |
| Example 19 | 1.29 | 0.09 | 96% | A | A | 93% |
| Example 20 | 1.26 | 0.09 | 97% | A | A | 95% |
| Example 21 | 1.28 | 0.10 | 96% | A | A | 94% |
| Example 22 | 1.28 | 0.10 | 80% | A | A | 88% |
| Example 23 | 1.28 | 0.08 | 82% | A | A | 90% |
| Example 24 | 1.26 | 0.10 | 98% | A | B | 96% |
| Example 25 | 1.28 | 0.08 | 75% | A | A | 88% |
| Example 26 | 1.28 | 0.09 | 92% | A | A | 95% |
| Example 27 | 1.25 | 0.08 | 95% | A | A | 96% |
| Comparative Example 4 | 1.23 | 0.12 | 38% | B | A | 80% |
| Comparative Example 5 | 1.21 | 0.08 | 70% | C | B | 35% |
| Comparative Example 6 | 1.28 | 0.10 | 45% | B | C | 81% |
| Comparative Example 7 | 1.19 | 0.10 | 70% | A | A | 70% |

It can be understood from Table 2 that the thermosensitive recording materials obtained in Examples 18 to 27 are superior in each of sensitivity, background fogging, storage stability of colored images, chemical resistance, resistance to inkjet inks and sticking properties.

Further, it can be understood from Table 2 that the thermosensitive recording materials according to Comparative Examples 4 to 7 are inferior in each of sensitivity, background fogging, image preservability and chemical resistance.

TABLE 3

| | Sensitivity | Background fogging | Image retention rate (%) | Chemical resistance | Inkjet fogging |
|---|---|---|---|---|---|
| Example 28 | 1.32 | 0.06 | 90 | A | A |
| Example 29 | 1.33 | 0.06 | 89 | A | A |
| Example 30 | 1.25 | 0.10 | 92 | A | A |
| Example 31 | 1.31 | 0.06 | 91 | A | A |
| Example 32 | 1.34 | 0.07 | 89 | A | A |
| Example 33 | 1.32 | 0.07 | 91 | A | A |
| Example 34 | 1.33 | 0.07 | 92 | A | A |
| Example 35 | 1.27 | 0.10 | 85 | A | A |
| Example 36 | 1.31 | 0.06 | 92 | A | A |
| Example 37 | 1.34 | 0.07 | 91 | A | A |
| Comparative Example 8 | 1.21 | 0.07 | 70 | C | C |
| Comparative Example 9 | 1.15 | 0.10 | 60 | A | C |
| Comparative Example 10 | 1.16 | 0.10 | 92 | A | A |
| Comparative Example 11 | 1.15 | 0.12 | 91 | A | A |

toluidino)-fluorane was used as the electron-donating colorless dye were not satisfactory from the viewpoint of sensitivity.

TABLE 4

| | Sensitivity | Background fogging | Image retention rate (%) | Background light fastness | Chemical resistance | Inkjet fogging |
|---|---|---|---|---|---|---|
| Example 38 | 1.30 | 0.06 | 90 | 0.07 | A | A |
| Example 39 | 1.29 | 0.06 | 91 | 0.07 | A | A |
| Example 40 | 1.31 | 0.07 | 89 | 0.06 | A | A |
| Example 41 | 1.30 | 0.07 | 91 | 0.07 | A | A |
| Example 42 | 1.31 | 0.07 | 92 | 0.07 | A | A |
| Example 43 | 1.28 | 0.06 | 87 | 0.07 | A | A |
| Example 44 | 1.25 | 0.06 | 92 | 0.06 | A | A |
| Example 45 | 1.30 | 0.06 | 92 | 0.06 | A | A |
| Example 46 | 1.33 | 0.07 | 91 | 0.07 | A | A |
| Comparative Example 12 | 1.20 | 0.07 | 70 | 0.08 | C | C |
| Comparative Example 13 | 1.16 | 0.10 | 60 | 0.07 | A | C |
| Comparative Example 14 | 1.16 | 0.10 | 92 | 0.10 | A | A |
| Comparative Example 15 | 1.15 | 0.12 | 91 | 0.12 | A | A |

It can be understood from Table 4 that the thermosensitive recording materials obtained in Examples 38 to 46 of the invention are superior in any of sensitivity, background fogging, storage stability of colored images, chemical resistance and adaptability to inkjet recording (fogging). On the other hand, the thermosensitive recording material obtained in Comparative Example 12 in which bisphenol A was used as the electron-accepting compound was not satisfactory from the viewpoints of sensitivity, image preservability, chemical resistance and inkjet fogging; and the thermosensitive recording material obtained in Comparative Example 13 in which N-benzyl-4-hydroxybenzenesulfonamide was used as the electron-accepting compound was not satisfactory from the viewpoints of sensitivity, image preservability and inkjet fogging. Further, the thermosensitive recording material obtained in Comparative Example 14 in which 2-anilino-3-methyl-6-(N-cyclohexyl-N-methyl)aminofluorane was used as the electron-donating colorless dye and the thermosensitive recording material obtained in Comparative Example 15 in which 3-dimethylamino-6-methyl-7-(m-toluidino)-fluorane was used as the electron-donating colorless dye were not satisfactory from the viewpoint of sensitivity.

It can be understood from Table 5 that the thermosensitive recording materials obtained in Examples 47 to 53 of the invention are superior in any of sensitivity, background fogging, storage stability of colored images, chemical resistance, anti-sticking properties and adaptability to inkjet recording (fogging).

On the other hand, the thermosensitive recording material obtained in Comparative Example 16 in which bisphenol A was used as the electron-accepting compound was not satisfactory from the viewpoints of sensitivity, image preservability, chemical resistance, anti-sticking properties and inkjet fogging; and the thermosensitive recording material obtained in Comparative Example 17 in which N-benzyl-4-hydroxybenzenesulfonamide was used as the electron-accepting compound was not satisfactory from the viewpoints of sensitivity, image preservability and inkjet fogging. Further, the thermosensitive recording obtained in Example 54 in which 2-anilino-3-methyl-6-(N-cyclohexyl-N-methyl) aminofluorane was used as the electron-donating colorless dye was not satisfactory from the viewpoint of sensitivity; and the thermosensitive recording material obtained in Example 55 in which no image stabilizer was used was not satisfactory from the viewpoint of image preservability.

What is claimed is:

1. A thermosensitive recording material comprising a support having thereon a thermosensitive color developing

TABLE 5

| | Sensitivity | Background fogging | Image retention rate (%) | Chemical resistance | Anti-sticking properties | Inkjet fogging |
|---|---|---|---|---|---|---|
| Example 47 | 1.31 | 0.06 | 98 | A | A | A |
| Example 48 | 1.32 | 0.06 | 97 | A | A | A |
| Example 49 | 1.29 | 0.06 | 100 | A | A | A |
| Example 50 | 1.29 | 0.06 | 97 | A | A | A |
| Example 51 | 1.32 | 0.06 | 96 | A | A | A |
| Example 52 | 1.30 | 0.06 | 99 | A | A | A |
| Example 53 | 1.25 | 0.06 | 100 | A | A | A |
| Comparative Example 16 | 1.21 | 0.07 | 80 | C | B | C |
| Comparative Example 17 | 1.12 | 0.06 | 77 | A | A | C |
| Example 54 | 1.14 | 0.10 | 99 | A | A | A |
| Example 55 | 1.32 | 0.06 | 90 | A | A | A |

layer containing at least an electron-donating colorless dye and an electron-accepting compound, wherein the thermosensitive color developing layer contains 4-hydroxybenzenesulfone anilide as the electron-accepting compound, and a thermosensitive recording surface of the thermosensitive recording material has an Oken smoothness of at least 300 seconds, wherein the thermosensitive color developing layer further contains at least one selected from 2-benzyloxynaphthalene, dimethylbenzyl oxalate, m-terphenyl, ethylene glycol tolyl ether, p-benzylbiphenyl, and 1,2-diphenoxymethylbenzene as a sensitizer.

2. A thermosensitive recording material comprising a support having thereon a thermosensitive color developing layer containing an electron-donating colorless dye and an electron-accepting compound, wherein the thermosensitive color developing layer contains 4-hydroxybenzenesulfone anilide as the electron-accepting compound and 1,1,3-tris (2-methyl-4-hydroxy-5-tert-butylphenyl)butane and/or 1,1,3-tris(2-methyl-4-hydroxy-5-cyclohexylphenyl) butane as an image stabilizer.

3. The thermosensitive recording material of claim 2, wherein the amount of the image stabilizer used is from 10 to 100 parts by mass based on 100 parts by mass of the electron-donating colorless dye.

4. The thermosensitive recording material of claim 2, wherein a sensitizer in the thermosensitive recording material contains 2-benzyloxynaphthalene and stearic acid amide.

5. The thermosensitive recording material of claim 4, wherein a mass ratio (x/y) of the 2-benzyloxynaphthalene (x) to the stearic acid amide (y) is from 95/5 to 40/60.

6. A thermosensitive recording material comprising a support having thereon a thermosensitive color developing layer containing an electron-donating colorless dye, an electron-accepting compound and a sensitizer, wherein the thermosensitive color developing layer contains 2-anilino-3-methyl-6-(N-ethyl-N-p-benzyl)aminofluorane as the electron-donating colorless dye and 4-hydroxybenzenesulfone anilide as the electron-accepting compound, wherein the sensitizer is at least one selected from 2-benzylnaphthyl ether, 1,2-bis(3-methylphenoxy)ethane, and 1,2-diphenoxymethylbenzene.

7. A thermosensitive recording material comprising a support having thereon a thermosensitive color developing layer containing an electron-donating colorless dye and an electron-accepting compound, wherein the thermosensitive color developing layer contains at least one selected from 2-anilino-3-methyl-6-di-n-butylaminofluorane and 2-anilino-3-methyl-6- di-n-amylaminofluorane as the electron-donating colorless dye and 4-hydroxybenzenesulfone anilide as the electron-accepting compound, wherein the thermosensitive color developing layer contains a sensitizer, and the sensitizer is at least one selected from 2-benzylnaphthyl ether, 1,2-bis (3-methylphenoxy)ethane, and 1,2-diphenoxymethylbenzene.

8. The thermosensitive recording material of claim 7, wherein the sensitizer is contained in an amount of from 100 to 300 parts by mass based on 100 parts by mass of the electron-donating colorless dye, wherein the sensitizer is contained in an amount of from 100 to 300 parts by mass based on 100 parts by mass of the electron-donating colorless dye.

9. A thermosensitive recording material comprising a support having thereon a thermosensitive color developing layer containing an electron-donating colorless dye, an electron-accepting compound and an image stabilizer, wherein the thermosensitive color developing layer contains at least one selected from 2-anilino-3-methyl-6-di-n-butyl- aminofluorane, 2-anilino-3-methyl-6-di-n-amylaminofluorane and 2-anilino-3-methyl-6-(N- ethyl-N-p-benzyl)aminofluorane as the electron-donating colorless dye and 4-hydroxy- benzenesulfone anilide as the electron-accepting compound.

10. The thermosensitive recording material of claim 9, wherein the image stabilizer is at least one of 1,1,3-tris(2-methyl-4-hydroxy-5-tert-butylphenyl)butane and 1,1,3-tris (2-methyl-4-hydroxy-5-cyclohexylphenyl)butane.

11. The thermosensitive recording material of claim 9, wherein the image stabilizer is contained in an amount of from 10 to 100 parts by mass based on 100 parts by mass of the electron-donating colorless dye.

* * * * *